US012649640B2

(12) United States Patent
Shimosaka et al.

(10) Patent No.: US 12,649,640 B2
(45) Date of Patent: Jun. 9, 2026

(54) MEDIUM DISCHARGE DEVICE, CONTROL METHOD, AND CONTROL PROGRAM

(71) Applicant: PFU LIMITED, Kahoku (JP)

(72) Inventors: Kiichiro Shimosaka, Kahoku (JP); Syuichi Morikawa, Kahoku (JP)

(73) Assignee: PFU LIMITED, Kahoku (JP)

( * ) Notice: Subject to any disclaimer, the term of this patent is extended or adjusted under 35 U.S.C. 154(b) by 265 days.

(21) Appl. No.: 18/559,521

(22) PCT Filed: May 19, 2021

(86) PCT No.: PCT/JP2021/019057
§ 371 (c)(1),
(2) Date: Jun. 11, 2024

(87) PCT Pub. No.: WO2022/244163
PCT Pub. Date: Nov. 24, 2022

(65) Prior Publication Data

US 2024/0317538 A1 Sep. 26, 2024

(51) Int. Cl.
*B65H 43/08* (2006.01)
*B65H 29/12* (2006.01)
(Continued)

(52) U.S. Cl.
CPC ..... *B65H 43/08* (2013.01); *B65H 29/125* (2013.01); *B65H 29/14* (2013.01); *B65H 43/04* (2013.01)

(58) Field of Classification Search
CPC ..... B65H 43/04; B65H 43/08; B65H 29/12; B65H 29/125; B65H 29/14; B65H 31/20;
(Continued)

(56) References Cited

U.S. PATENT DOCUMENTS 7,942,413 B2 * 5/2011 Eguchi ..... G03G 15/6552 271/278

FOREIGN PATENT DOCUMENTS

JP 2000-118824 A 4/2000
JP 2001-122498 A 5/2001
(Continued)

OTHER PUBLICATIONS

Japanese Office Action dated Feb. 7, 2024 regarding Japanese Patent Application No. 2023-522099 corresponding to U.S. Appl. No. 18/559,521 (3 pages) with English Translation (5 pages).
(Continued)

*Primary Examiner* — Jeremy R Severson
(74) *Attorney, Agent, or Firm* — Womble Bond Dickinson (US) LLP

(57) ABSTRACT

Provided are a medium ejection apparatus, a control method, and a control program to enable precise determination of whether abnormal ejection of a medium has occurred. A medium ejection apparatus includes an ejection roller to eject a medium, a tray to stack the medium ejected by the ejection roller, a first optical sensor located above the ejection roller and including a first light emitter to emit light toward the tray and a first light receiver to generate a first optical signal based on received light, a second optical sensor located above the ejection roller and including a second light emitter to emit light toward a downstream side of the tray in a medium ejecting direction and a second light receiver to generate a second optical signal based on received light, a determination module to determine whether abnormal ejection of the medium has occurred based on the first optical signal and the second optical signal, and a control module to execute abnormality processing when it is determined that abnormal ejection of the medium has occurred.

20 Claims, 23 Drawing Sheets

(51) Int. Cl.
*B65H 29/14* (2006.01)
*B65H 43/04* (2006.01)

(58) Field of Classification Search
CPC ..... B65H 2405/11164; B65H 2405/111643; B65H 2405/111646; B65H 2405/1122; B65H 2405/1124
See application file for complete search history.

(56) References Cited

FOREIGN PATENT DOCUMENTS

| | | | |
|---|---|---|---|
| JP | 2003-26370 | A | 1/2003 |
| JP | 2007-119148 | A | 5/2007 |
| JP | 2009-120321 | A | 6/2009 |
| JP | 2020-203761 | A | 12/2020 |
| JP | 2021-14328 | A | 2/2021 |

OTHER PUBLICATIONS

International Search Report dated Jun. 29, 2021 for corresponding PCT Application No. PCT/JP2021/019057 (3 pages) with English Translation (2 pages).
Written Opinion dated Jun. 29, 2021 for corresponding PCT Application No. PCT/JP2021/019057 (4 pages) with English Translation (4 pages).
International Preliminary Report on Patentability dated Nov. 21, 2023 for corresponding PCT Application No. PCT/JP2021/019057 (5 pages) with English Translation (5 pages).

* cited by examiner (a)

(b)

(a)

(b)

(a)

(b)

(c)

(a)

(b)

(a)

(b)

MEDIUM DISCHARGE DEVICE, CONTROL METHOD, AND CONTROL PROGRAM

CROSS REFERENCE TO RELATED APPLICATIONS

This application is a U.S. National Phase Patent Application of International Application Number PCT/JP2021/019057, filed on May 19, 2021, the entire content of which is incorporated herein by reference.

TECHNICAL FIELD

The present disclosure relates to a medium ejection apparatus, a control method, and a control program and particularly relates to a medium ejection apparatus, a control method, and a control program for stacking an ejected medium onto a tray.

BACKGROUND ART

A medium ejection apparatus, such as a scanner, images a plurality of media while sequentially conveying the media and ejects the media onto a tray. Abnormal ejection of a medium such as curling of an ejected medium, non-falling of a rear edge of a medium, flying out of a medium being ejected from the tray, push-out of a medium which has been ejected by a medium being ejected, or change in the order of media stacked on the tray may occur in such a medium ejection apparatus. When a medium continues to be ejected in a state in which curling of the medium or non-falling of the rear edge of the medium is occurring, jamming of the medium ejected on the tray may occur and the medium may be damaged. Further, when a medium continues to be ejected in a state in which flying out or push-out of the medium, or change in the order of media is occurring, it is difficult for a user to specify the medium for which flying out, push-out, or change in the order is occurring, and time and effort spent by the user on reordering of the media increases. Therefore, the medium ejection apparatus is required to stop ejection of a medium, reduce the ejection speed of a medium, or notify a user when abnormal ejection of a medium occurs.

An image forming apparatus to detect a paper stacking state on a paper ejection tray at a plurality of points in ejecting direction of an ejection means and stop ejection of the paper by the ejection means when the paper ejection tray is full is disclosed (see PTL 1).

A paper stacking apparatus to detect an ejection state of paper ejected onto a paper ejection tray from an outlet and determine whether to continue or stop ejection of subsequent paper based on the detection information, is disclosed (see PTL 2).

CITATION LIST

Patent Literature

[PTL 1]
Japanese Unexamined Patent Publication (Kokai) No. 2009-120321

[PTL 2]
Japanese Unexamined Patent Publication (Kokai) No. 2003-26370

SUMMARY OF INVENTION

A medium ejection apparatus is required to precisely determine whether abnormal ejection of a medium has occurred.

An object of a medium ejection apparatus, a control method, and a control program is to enable precise determination of whether abnormal ejection of a medium has occurred.

According to some embodiments, a medium ejection apparatus includes an ejection roller to eject a medium, a tray to stack the medium ejected by the ejection roller, a first optical sensor located above the ejection roller and including a first light emitter to emit light toward the tray and a first light receiver to generate a first optical signal based on received light, a second optical sensor located above the ejection roller and including a second light emitter to emit light toward a downstream side of the tray in a medium ejecting direction and a second light receiver to generate a second optical signal based on received light, a determination module to determine whether abnormal ejection of the medium has occurred based on the first optical signal and the second optical signal, and a control module to execute abnormality processing when it is determined that abnormal ejection of the medium has occurred.

According to some embodiments, a medium ejection apparatus includes an ejection roller to eject a medium, a facing roller located in such a way as to face the ejection roller, a tray to stack the medium ejected by the ejection roller, a first optical sensor located above the ejection roller and including a first light emitter to emit light toward an upstream side of an intersection of an extension of a nip surface of the ejection roller and the facing roller, and a placement surface of the tray in a medium ejecting direction, and a first light receiver to generate a first optical signal based on received light, a second optical sensor located above the ejection roller and including a second light emitter to emit light toward a downstream side of the intersection in a medium ejecting direction and a second light receiver to generate a second optical signal based on received light, a determination module to determine whether abnormal ejection of the medium has occurred based on the first optical signal and the second optical signal, and a control module to execute abnormality processing when it is determined abnormal ejection of the medium has occurred.

According to some embodiments, a control method of medium ejection apparatus includes ejecting a medium by an ejection roller, stacking the medium ejected by the ejection roller onto a tray, determining whether abnormal ejection of the medium has occurred based on, a first optical signal generated by a first optical sensor located above the ejection roller and including a first light emitter to emit light toward the tray and a first light receiver to generate the first optical signal based on received light and a second optical signal generated by a second optical sensor located above the ejection roller and including a second light emitter to emit light toward a downstream side of the tray in a medium ejecting direction and a second light receiver to generate the second optical signal based on received light, and executing abnormality processing when it is determined that abnormal ejection of the medium has occurred.

According to some embodiments, a control method of medium ejection apparatus includes ejecting a medium by an ejection roller, stacking the medium ejected by the ejection roller onto a tray, determining whether abnormal ejection of the medium has occurred based on, a first optical signal generated by a first optical sensor located above the ejection roller and including a first light emitter to emit light toward an upstream side of an intersection of an extension of a nip surface of the ejection roller and the facing roller, and a placement surface of the tray in a medium ejecting direction, and a first light receiver to generate the first optical signal based on received light, and a second optical signal generated by a second optical sensor located above the ejection roller and including a second light emitter to emit light toward a downstream side of the intersection in a medium ejecting direction and a second light receiver to generate the second optical signal based on received light, and executing abnormality processing when it is determined that abnormal ejection of the medium has occurred.

According to some embodiments, a control program of a medium ejection apparatus including an ejection roller to eject a medium, a tray to stack the medium ejected by the ejection roller, a first optical sensor located above the ejection roller and including a first light emitter to emit light toward the tray and a first light receiver to generate a first optical signal based on received light, and a second optical sensor located above the ejection roller and including a second light emitter to emit light toward a downstream side of the tray in a medium ejecting direction and a second light receiver to generate a second optical signal based on received light, causes the medium ejection apparatus to execute determining whether abnormal ejection of the medium has occurred based on the first optical signal and the second optical signal, and executing abnormality processing when it is determined that abnormal ejection of the medium has occurred.

According to some embodiments, a control program of a medium ejection apparatus including an ejection roller to eject a medium, a tray to stack the medium ejected by the ejection roller, a first optical sensor located above the ejection roller and including a first light emitter to emit light toward an upstream side of an intersection of an extension of a nip surface of the ejection roller and the facing roller, and a placement surface of the tray in a medium ejecting direction, and a first light receiver to generate a first optical signal based on received light, and a second optical sensor located above the ejection roller and including a second light emitter to emit light toward a downstream side of the intersection in a medium ejecting direction and a second light receiver to generate a second optical signal based on received light, causes the medium ejection apparatus to execute determining whether abnormal ejection of the medium has occurred based on the first optical signal and the second optical signal, and executing abnormality processing when it is determined that abnormal ejection of the medium has occurred.

According to the embodiments, the medium ejection apparatus, the control method, and the control program can precisely determine whether abnormal ejection of a medium has occurred.

The object and advantages of the invention will be realized and attained by means of the elements and combinations, in particular, described in the claims. It is to be understood that both the foregoing general description and the following detailed description are exemplary and explanatory, and are not restrictive of the invention as claimed.

DESCRIPTION OF EMBODIMENTS

Hereinafter, a medium ejection apparatus, a control method and a control program according to embodiments of this disclosure, will be described with reference to the drawings. However, it should be noted that the technical scope of the invention is not limited to these embodiments, and extends to the inventions described in the claims and their equivalents.

Figure 1:
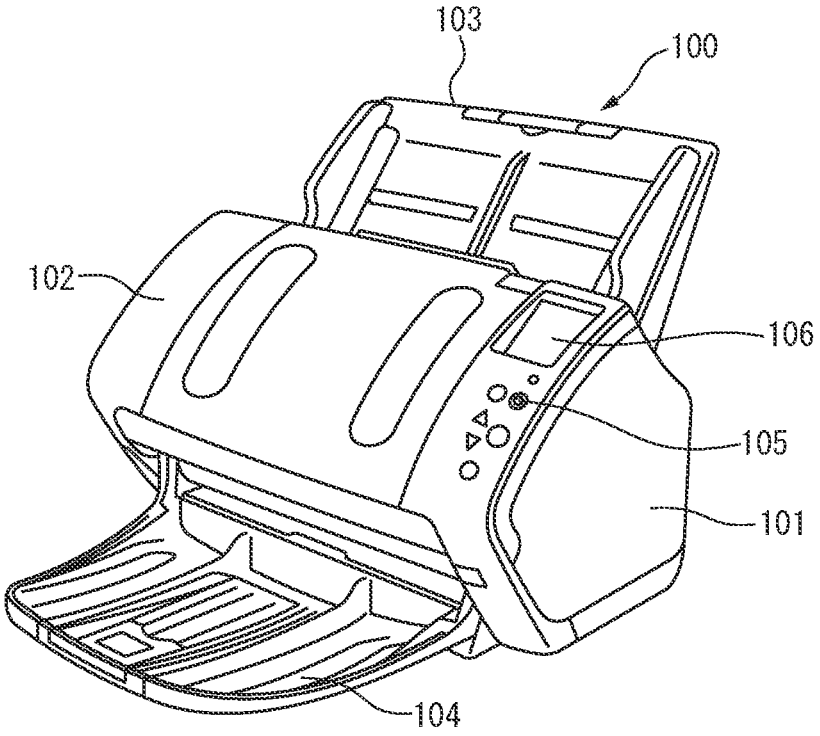
FIG. 1 is a perspective view illustrating an example of a medium ejection apparatus according to an embodiment.

FIG. 1 is a perspective view illustrating an example of a medium ejection apparatus configured as an image scanner. The medium ejection apparatus 100 conveys and images a medium being a document. Examples of a medium include paper, thick paper, a card, a booklet, and a passport. The medium ejection apparatus 100 may be a facsimile, a copying machine, a multifunctional peripheral (MFP), etc. A conveyed medium may be an object being printed, etc., instead of a document, and the medium ejection apparatus 100 may be a printer, etc.

The medium ejection apparatus 100 includes a lower housing 101, an upper housing 102, a loading tray 103, an ejection tray 104, an operation device 105, a display device 106, etc.

The upper housing 102 is located at a position covering the top surface of the medium ejection apparatus 100 and is engaged with the lower housing 101 by a hinge such that it can be opened when, for example, a medium is stuck or cleaning of the inside of the medium ejection apparatus 100 is performed.

The loading tray 103 is engaged with the lower housing 101 such that a medium to be fed and conveyed can be placed. The ejection tray 104 is an example of a tray, and is engaged with the lower housing 101 such that an ejected medium can be stacked.

The operation device 105 includes an input device such as a button, and an interface circuit acquiring a signal from the input device, accepts an input operation by a user, and outputs an operation signal based on the input operation by the user. The display device 106 includes a display including a liquid crystal, an organic electro-luminescence (EL), etc. and an interface circuit outputting image data to the display, and displays the image data on the display.

Figure 2:
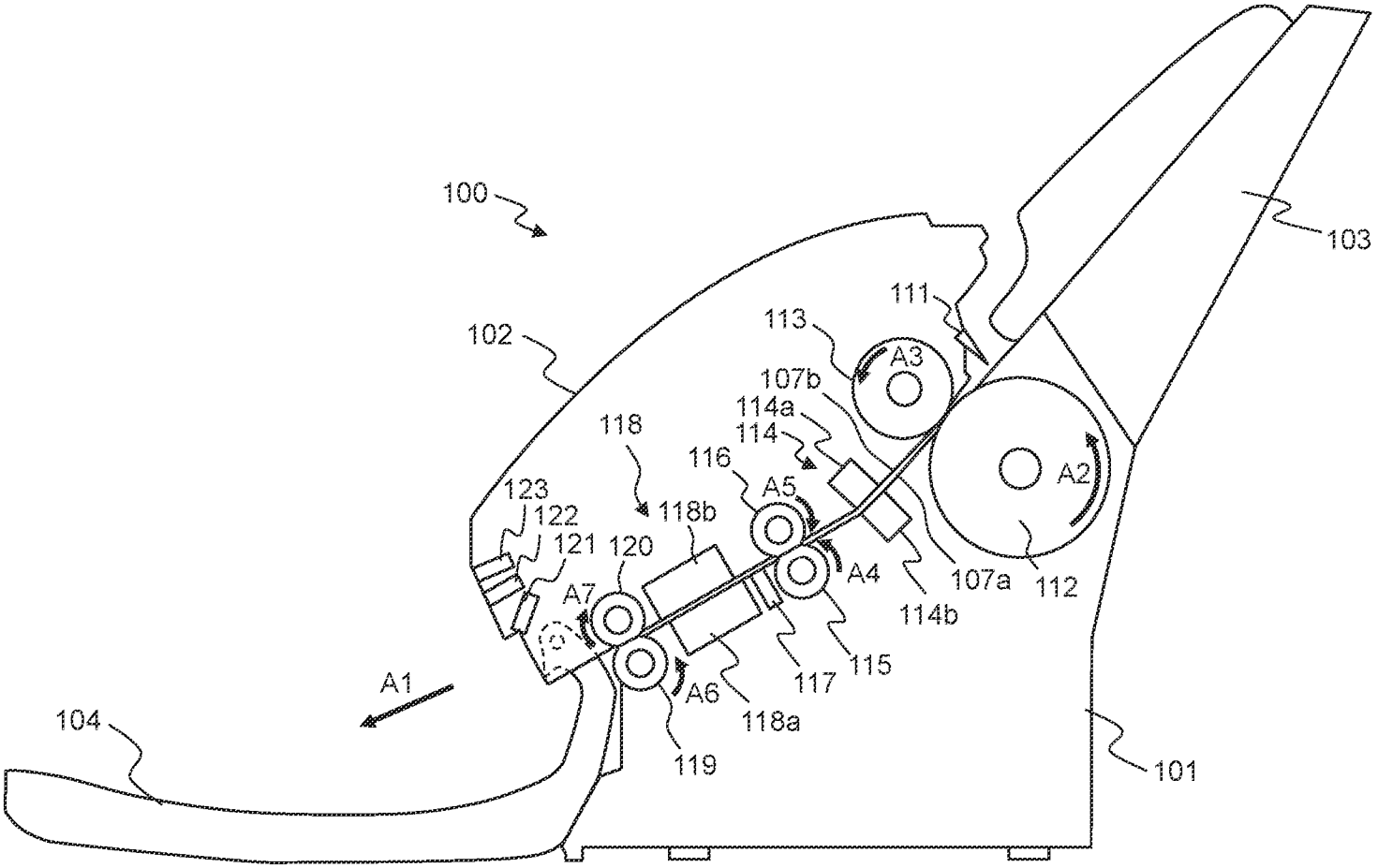
FIG. 2 is a diagram illustrating an example of a conveyance path inside a medium ejection apparatus.

FIG. 2 is a diagram illustrating an example of a conveyance path inside a medium ejection apparatus.

The conveyance path inside the medium ejection apparatus 100 includes a first medium sensor 111, a feed roller 112, a brake roller 113, an ultrasonic sensor 114, a first conveyance roller 115, a second conveyance roller 116, a second medium sensor 117, an imaging device 118, a first ejection roller 119, a second ejection roller 120, a first range sensor 121, a second range sensor 122, a third range sensor 123, etc.

Each of the numbers of the feed roller 112, the brake roller 113, the first conveyance roller 115, the second conveyance roller 116, the first ejection roller 119, and/or the second ejection roller 120 is not limited to one and may be more than one. In that case, a plurality of feed rollers 112, brake rollers 113, first conveyance rollers 115, second conveyance rollers 116, first ejection rollers 119, and/or second ejection rollers 120 are respectively spaced in a width direction perpendicular to a medium ejecting direction A1.

The top surface of the lower housing 101 forms a lower guide 101*a* of the conveyance path of a medium, and the bottom surface of the upper housing 102 forms an upper guide 102*a* of the conveyance path of a medium. An arrow A1 in FIG. 2 indicates a medium ejecting direction. An upstream hereinafter refers to an upstream in the medium ejecting direction A1, and a downstream refers to a downstream in the medium ejecting direction A1.

The first medium sensor 111 is located on the upstream side of the feed roller 112 and the brake roller 113. The first medium sensor 111 includes a contact detection sensor and detects whether a medium is placed on the loading tray 103. The first medium sensor 111 generates and outputs a medium signal the signal value of which varies between a state in which a medium is placed on the loading tray 103 and a state in which a medium is not placed. The first medium sensor 111 is not limited to a contact detection sensor and any other sensor that can detect the presence of a medium, such as a light detection sensor, may be used as the first medium sensor 111.

The feed roller 112 is provided in the lower housing 101, sequentially feeds media placed on the loading tray 103 from the lower side. The brake roller 113 is provided in the upper housing 102, in such a way as to face the feed roller 112. The feed roller 112 may be provided in the upper housing 102, the brake roller 113 may be provided in the lower housing 101, and the feed roller 112 may sequentially feed media placed on the loading tray 103 from the upper side.

The ultrasonic sensor 114 is located on the downstream side of the feed roller 112 and the brake roller 113 and on the upstream side of the first conveyance roller 115 and the second conveyance roller 116. The ultrasonic sensor 114 includes an ultrasonic transmitter 114*a* and an ultrasonic receiver 114*b*. The ultrasonic transmitter 114*a* and the ultrasonic receiver 114*b* are located close to the conveyance path of a medium in such a way as to face each other with the conveyance path in between. The ultrasonic transmitter 114*a* transmits an ultrasonic wave. The ultrasonic receiver 114*b* receives an ultrasonic wave transmitted by the ultrasonic transmitter 114*a* and passed through a medium and generates and outputs an ultrasonic signal being an electric signal based on the received ultrasonic wave. When a plurality of media are conveyed in a overlapped manner, an ultrasonic wave passing through the media is attenuated by an air layer between the media conveyed in a overlapped manner. Accordingly, the medium ejection apparatus 100 can detect multi feed of media based on the ultrasonic signal. Further, an ultrasonic wave passing through a medium is also attenuated by the medium itself, and an amount of attenuation increases as the thickness of the medium through which the ultrasonic wave passes increases. Accordingly, the medium ejection apparatus 100 can detect the thickness of the conveyed medium based on the ultrasonic signal.

The first conveyance roller 115 and the second conveyance roller 116 are located on the downstream side of the feed roller 112 in such a way as to face each other. The first conveyance roller 115 and the second conveyance roller 116 convey a medium fed by the feed roller 112 and the brake roller 113 to the imaging device 118.

The second medium sensor 117 is located on the downstream side of the first conveyance roller 115 and the second conveyance roller 116 and on the upstream side of the imaging device 118 and detects a medium conveyed to the position. The second medium sensor 117 includes a light emitter and a light receiver that are provided on one side of the medium conveyance path and a reflection member, such as a mirror, provided at a position facing the light emitter and the light receiver with the medium conveyance path in between. The light emitter is a light emitting diode (LED), etc., and emits light toward the medium conveyance path. The light receiver receives light emitted by the light emitter and reflected by the reflection member. When a medium is present at a position facing the second medium sensor 117, light emitted from the light emitter is blocked by the medium, and therefore the light receiver does not detect the light emitted from the light emitter. The light receiver generates and outputs a second medium signal the signal value of which varies between a state in which a medium is present at the position of the second medium sensor 117 and a state in which a medium is not present, based on the intensity of received light.

A light guide may be used in place of the reflection member. Further, the light emitter and the light receiver may be provided in such a way as to face each other with the medium conveyance path in between. Further, the second medium sensor 117 may detect the presence of a medium by a contact detection sensor to pass predetermined current when being in contact with a medium or not being in contact with a medium, etc.

The imaging device 118 includes a first imaging device 118*a* and a second imaging device 118*b* that are located in such a way as to face each other with the medium conveyance path in between. The first imaging device 118*a* includes a line sensor based on a unity-magnification optical system type contact image sensor (CIS) including complementary metal oxide semiconductor- (CMOS-) based imaging elements linearly arranged in a main scanning direction. The first imaging device 118*a* further includes lenses each forming an image on an imaging element, and an A/D converter amplifying and analog-digital (A/D) converting an electric signal output from the imaging element. The first imaging device 118*a* generates an input image by imaging the front side of a conveyed medium in accordance with control from a processing circuit to be described later and outputs the generated image.

Similarly, the second imaging device 118*b* includes a line sensor based on a unity-magnification optical system type CIS including CMOS-based imaging elements linearly arranged in the main scanning direction. The second imaging device 118*b* further includes lenses each forming an image on an imaging element, and an A/D converter amplifying and analog-digital (A/D) converting an electric signal output from the imaging element. The second imaging device 118*b* generates an input image by imaging the back side of a conveyed medium in accordance with control from the processing circuit to be described later and outputs the generated image.

Only one of the first imaging device 118*a* and the second imaging device 118*b* may be located and only one side of a medium may be read in the medium ejection apparatus 100. Further, a line sensor based on a unity-magnification optical system type CIS including charge coupled device-(CCD-) based imaging elements may be used in place of the line sensor based on a unity-magnification optical system type CIS including CMOS-based imaging elements. Further, a reduction optical system type line sensor including CMOS-based or CCD-based imaging elements may be used.

The first ejection roller 119 and the second ejection roller 120 are located on the downstream side of the imaging device 118 in such a way as to face each other. The first ejection roller 119 and the second ejection roller 120 eject a medium conveyed by the first conveyance roller 115 and the second conveyance roller 116 and imaged by the imaging device 118 onto the ejection tray 104. One of the first ejection roller 119 and the second ejection roller 120 is an example of an ejection roller, and the other of the first ejection roller 119 and the second ejection roller 120 is an example of a facing roller.

A medium placed on the loading tray 103 is conveyed between the lower guide 107*a* and the upper guide 107*b* toward the medium ejecting direction A1 by the feed roller 112 rotating in a direction of an arrow A2 in FIG. 2, i.e., the medium ejecting direction. The brake roller 113 rotates in a direction of an arrow A3, i.e., a direction opposite to the medium feeding direction at the time of medium conveying. When a plurality of media are placed on the loading tray 103, only a medium in contact with the feed roller 112 out of the medium placed on the loading tray 103 is separated by working of the feed roller 112 and the brake roller 113. Consequently, conveyance of a medium other than the separated medium is restricted (prevention of multi feed).

A medium is fed between the first conveyance roller 115 and the second conveyance roller 116 while being guided by the lower guide 107*a* and the upper guide 107*b*. The medium is fed between the first imaging device 118*a* and the second imaging device 118*b* by the first conveyance roller 115 and the second conveyance roller 116 rotating in directions of an arrow A4 and an arrow A5, respectively. The medium read by the imaging device 118 is ejected onto the ejection tray 104 by the first ejection roller 119 and the second ejection roller 120 rotating in directions of an arrow A6 and an arrow A7, respectively. The ejection tray 104 stacks a medium ejected by the first ejection roller 119 and the second ejection roller 120.

Figure 3:
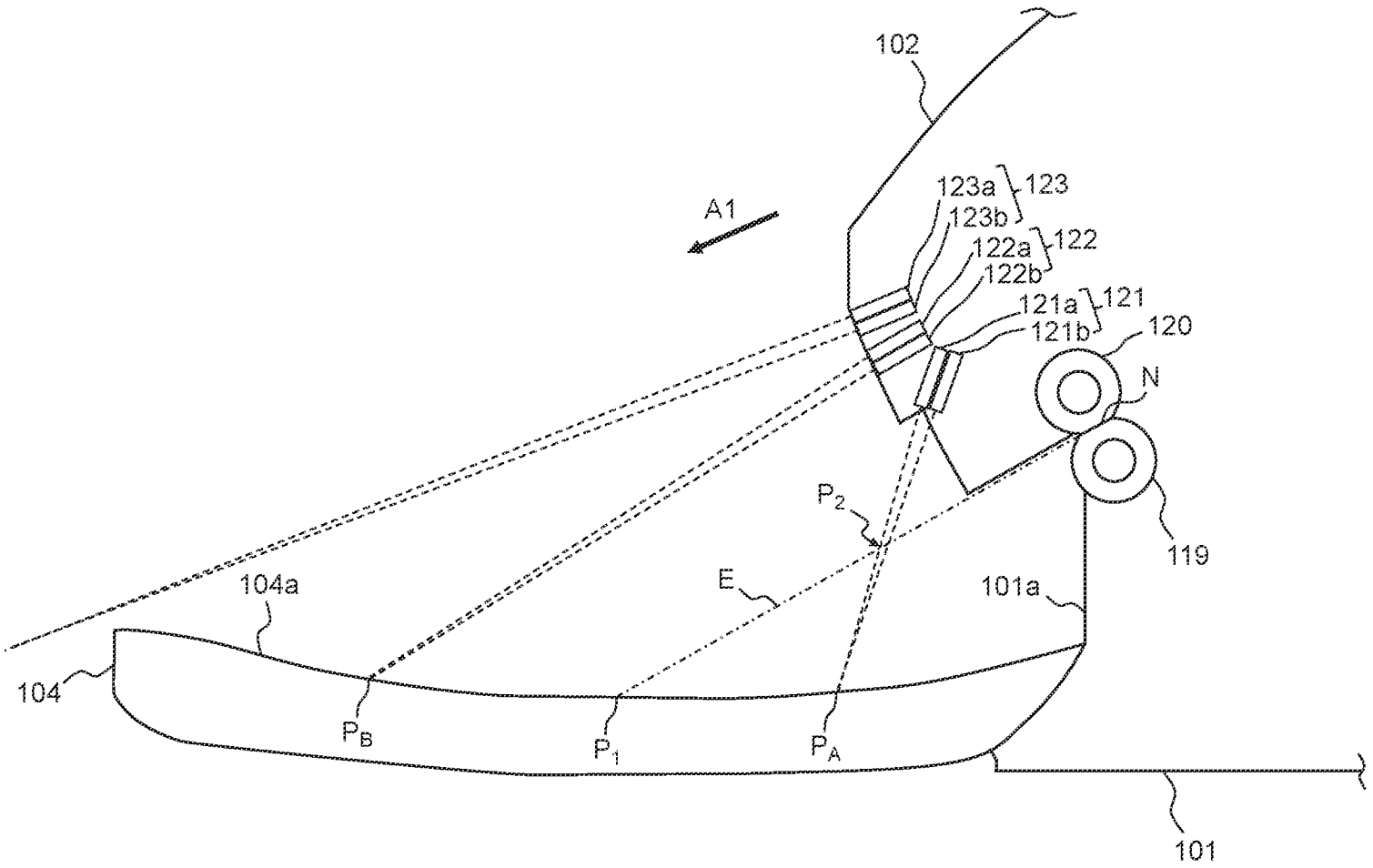
FIG. 3 is a schematic diagram illustrating an example of arrangement of a first range sensor, etc.

FIG. 3 is a schematic diagram illustrating an example of arrangement of a first range sensor, a second range sensor, and a third range sensor.

The first range sensor 121 and the second range sensor 122 are examples of a first optical sensor, and the second range sensor 122 and the third range sensor 123 are examples of a second optical sensor. The first range sensor 121, the second range sensor 122, and the third range sensor 123 are located in the upper housing 102 above the first ejection roller 119 and the second ejection roller 120. The second range sensor 122 is located above the first range sensor 121, and the third range sensor 123 is located above the second range sensor 122.

The first range sensor 121, the second range sensor 122, and/or the third range sensor 123 is located on the downstream side of the first ejection roller 119 and the second ejection roller 120 in the medium ejecting direction A1 and in the central part in the width direction perpendicular to the medium ejecting direction A1. The first range sensor 121, the second range sensor 122, and/or the third range sensor 123 may be located on an edge side in the width direction. Each of the numbers of the first range sensor 121, the second range sensor 122, and/or the third range sensor 123 is not limited to one and may be more than one. In that case, a plurality of first range sensors 121, second range sensors 122 and/or third range sensors 123 are respectively spaced in the width direction.

The first range sensor 121 is an infrared proximity sensor and measures the distance to an object present at a facing position based on the time difference between emission and reflection of infrared rays. The first range sensor 121 includes a first light emitter 121*a* and a first light receiver 121*b*. The first light emitter 121*a* and the first light receiver 121*b* are examples of a first light emitter and a first light receiver, respectively.

The first light emitter 121*a* is an infrared light emitting diode (LED), etc., and emits light (infrared light) toward the downstream side and toward a facing position in the width direction. The first light emitter 121*a* emits light toward the ejection tray 104 and particularly toward an area on the ejection tray 104 close to the first ejection roller 119 and the second ejection roller 120. The first light emitter 121*a* emits light toward a position $P_A$ on the upstream side of an intersection $P_1$ of an extension E of a nip surface N of the first ejection roller 119 and the second ejection roller 120, and a placement surface 104*a* of the ejection tray 104 in the medium ejecting direction A1. The light emitting direction of the first light emitter 121*a* is preferably set in such a way that the distance from a downstream-side edge of the nip surface N to an intersection $P_2$ of the extension E of the nip surface N and the light emitting direction is less than a minimum size of a medium supported by the medium ejection apparatus 100. Similarly, the emission position $P_A$ of the first light emitter 121*a* is preferably set in such a way that the distance to a wall surface 101*a* provided at a downstream-side edge of the lower housing 101 and being in contact with an upstream-side edge of a medium stacked on the ejection tray 104 is less than the minimum size of a medium. Thus, the medium ejection apparatus 100 can reliably detect an ejected medium in any size.

The first light receiver 121*b* is an infrared photodiode, etc. The first light receiver 121*b* receives light emitted by the first light emitter 121*a* and reflected by the ejection tray 104 or a medium ejected by the first ejection roller 119 and the second ejection roller 120 and generates and outputs a first ranging signal being an electric signal based on the received light. The first ranging signal is an example of a first optical signal and indicates the time elapsed after the first light emitter 121*a* emits light until the first light receiver 121*b* receives the light.

The second range sensor 122 is an infrared proximity sensor and measures the distance to an object present at a facing position based on the time difference between emission and reflection of infrared rays. The second range sensor 122 includes a second light emitter 122*a* and a second light receiver 122*b*. The second light emitter 122*a* and the second light receiver 122*b* are examples of the first light emitter and the first light receiver, or a second light emitter and a second light receiver, respectively.

The second light emitter 122*a* is an infrared LED, etc., and emits light toward the downstream side and toward a facing position in the width direction. The second light emitter 122*a* emits light toward the ejection tray 104 at an angle different from that of the first light emitter 121*a* and particularly toward an area between the emission position of the first light emitter 121*a* and the emission position of the third light emitter 123*a*. The second light emitter 122*a* emits light toward a position $P_B$ on the downstream side of the intersection $P_1$ of the extension E of the nip surface N of the first ejection roller 119 and the second ejection roller 120, and the placement surface 104*a* of the ejection tray 104 in the medium ejecting direction A1. In other words, the emission position $P_B$ of the second light emitter 122*a* is set on the downstream side of the emission position $P_A$ of the first light emitter 121*a*. Further, the emission position $P_B$ of the second light emitter 122*a* is set in such a way that the distance to the wall surface 101*a* is less than a value acquired by adding a margin (such as 10 mm) to a maximum size of a medium supported by the medium ejection apparatus 100.

On the other hand, the second light receiver 122*b* is an infrared photodiode, etc. The second light receiver 122*b* receives light emitted by the second light emitter 122*a* and reflected by the ejection tray 104 or a medium ejected by the first ejection roller 119 and the second ejection roller 120 and generates and outputs a second ranging signal being an electric signal based on the received light. The second ranging signal is an example of the first optical signal or a second optical signal and indicates the time elapsed after the second light emitter 122*a* emits light until the second light receiver 122*b* receives the light.

The third range sensor 123 is an infrared proximity sensor and measures the distance to an object present at a facing position based on the time difference between emission and reflection of infrared rays. The third range sensor 123 includes a third light emitter 123*a* and a third light receiver 123*b*. The third light emitter 123*a* and the third light receiver 123*b* are examples of the second light emitter and the second light receiver, respectively.

The third light emitter 123*a* is an infrared LED, etc., and emits light toward the downstream side and toward a facing position in the width direction. The third light emitter 123*a* emits light toward the downstream side of the ejection tray 104 in the medium ejecting direction A1 at an angle different from those of the first light emitter 121*a* and the second light emitter 122*a*. In other words, the emission position of the third light emitter 123*a* is set on the downstream side of the emission position $P_B$ of the second light emitter 122*a*. The third light emitter 123*a* may emit light toward a direction parallel with the placement surface 104*a* of the ejection tray 104. When the ejection tray 104 is extensible, the third light emitter 123*a* may emit light toward the downstream side of the ejection tray 104 in a most extended state in the medium ejecting direction A1.

The third light receiver 123*b* is an infrared photodiode, etc. The third light receiver 123*b* receives light emitted by the third light emitter 123*a* and reflected by an installation surface on which the medium ejection apparatus 100 is installed or a medium ejected by the first ejection roller 119 and the second ejection roller 120 and generates and outputs a third ranging signal being an electric signal based on the received light. The third ranging signal is an example of the second optical signal and indicates the time elapsed after the third light emitter 123*a* emits light until the third light receiver 123*b* receives the light.

For example, a known infrared proximity sensor that can measure a distance at a resolution of 1 mm in a range of 0 to 100 mm can be used as the first range sensor 121, the second range sensor 122, and the third range sensor 123. One of the first range sensor 121, the second range sensor 122, and the third range sensor 123 may be omitted.

Figure 4:
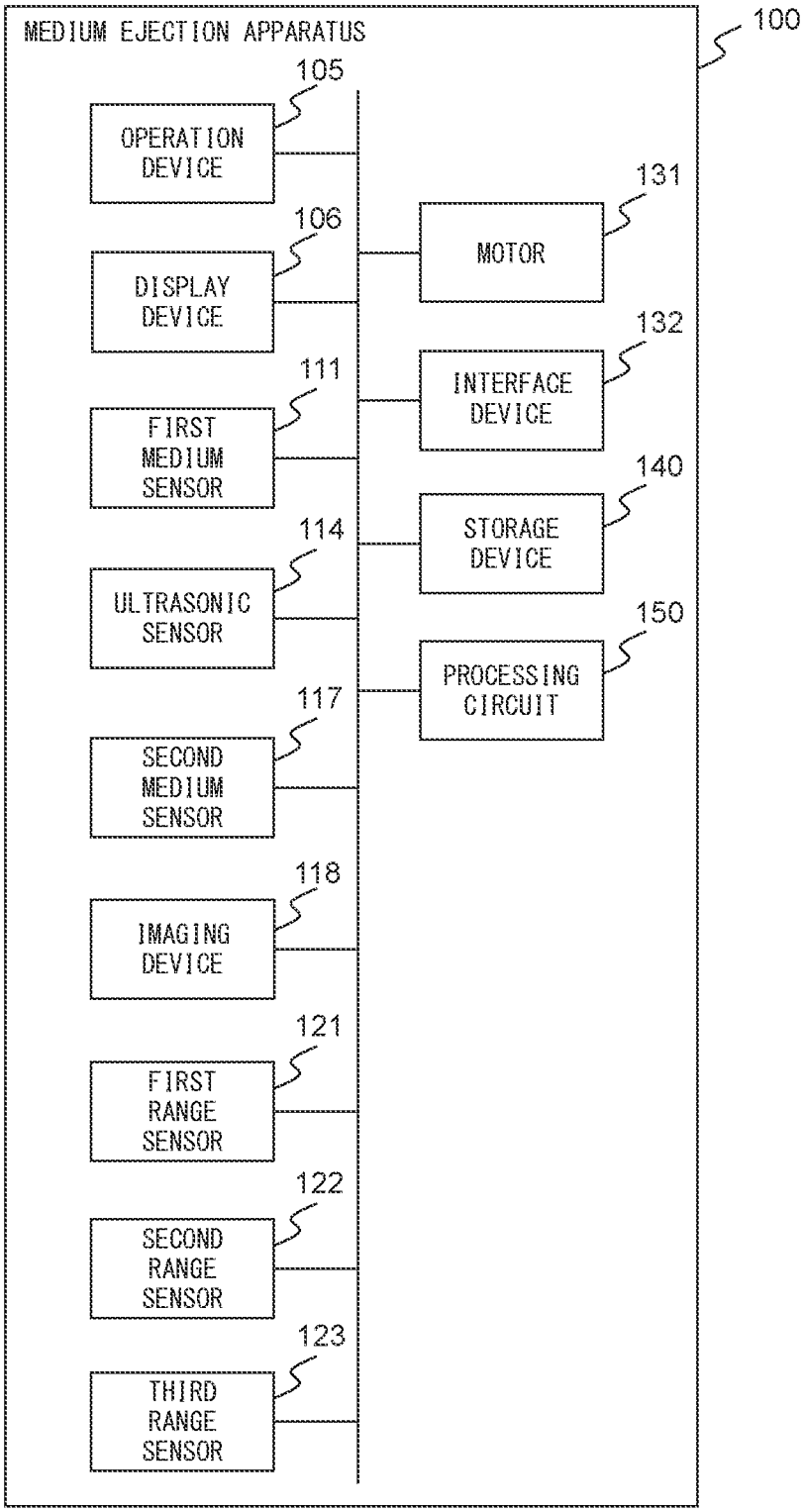
FIG. 4 is a block diagram illustrating a schematic configuration of an example of a medium ejection apparatus.

FIG. 4 is a block diagram illustrating a schematic configuration of an example of a medium ejection apparatus.

In addition to the configuration described above, the medium ejection apparatus 100 further includes a motor 131, an interface device 132, a storage device 140, a processing circuit 150, etc.

The motor 131 includes one or a plurality of motors and conveys a medium by rotating the feed roller 112, the brake roller 113, the first conveyance roller 115, the second conveyance roller 116, the first ejection roller 119, and the second ejection roller 120 in accordance with a control signal from the processing circuit 150. One of the first conveyance roller 115 and the second conveyance roller 116 may be a driven roller driven to rotate by the other roller. One of the first ejection roller 119 and the second ejection roller 120 may be a driven roller driven to rotate by the other roller.

For example, the interface device 132 includes an interface circuit conforming to a serial bus such as USB and transmits and receives an input image and various types of information by being electrically connected to an unillustrated information processing apparatus (such as a personal computer or a mobile information terminal). A communication device including an antenna transmitting and receiving wireless signals and a wireless communication interface circuit for transmitting and receiving signals through a wireless communication line in accordance with a predetermined communication protocol may be used in place of the interface device 132. For example, the predetermined communication protocol is a wireless local area network (LAN). The communication device may include a wired communication interface circuit for transmitting and receiving signals through a wired communication line in accordance with a communication protocol such as a wired LAN.

The storage device 140 includes a memory device such as a random-access memory (RAM) or a read-only memory (ROM), a fixed disk device such as a hard disk, a portable storage device such as a flexible disk or an optical disk, etc. Further, a computer program, a database, a table, etc., that are used for various types of processing in the medium ejection apparatus 100 are stored in the storage device 140. The computer programs may be installed on the storage device 140 from a computer-readable, non-transitory portable storage medium by using a well-known set-up program, etc. The portable storage medium is, for example, a compact disc read-only memory (CD-ROM) or a digital versatile disc read-only memory (DVD-ROM).

The processing circuit 150 operates in accordance with a program stored in advance in the storage device 140. For example, the processing circuit is a central processing unit (CPU). A digital signal processor (DSP), a large scale integration (LS1), an application specific integrated circuit (AS1C), and a field-programmable gate array (FPGA) may be used as the processing circuit 150.

The processing circuit 150 is connected to the operation device 105, the display device 106, the first medium sensor 111, the ultrasonic sensor 114, the second medium sensor 117, the imaging device 118, the first range sensor 121, the second range sensor 122, the third range sensor 123, the motor 131, the interface device 132, the storage device 140, etc., and controls each of them. The processing circuit 150 performs drive control of the motor 131, imaging control of the imaging device 118, etc., acquires an input image from the imaging device 118, and transmits the image to the information processing apparatus through the interface device 132. Further, the processing circuit 150 determines whether abnormal ejection of a medium has occurred based on the first ranging signal, the second ranging signal, and the third ranging signal that are generated by the first range sensor 121, the second range sensor 122, and the third range sensor 123.

Figure 5:
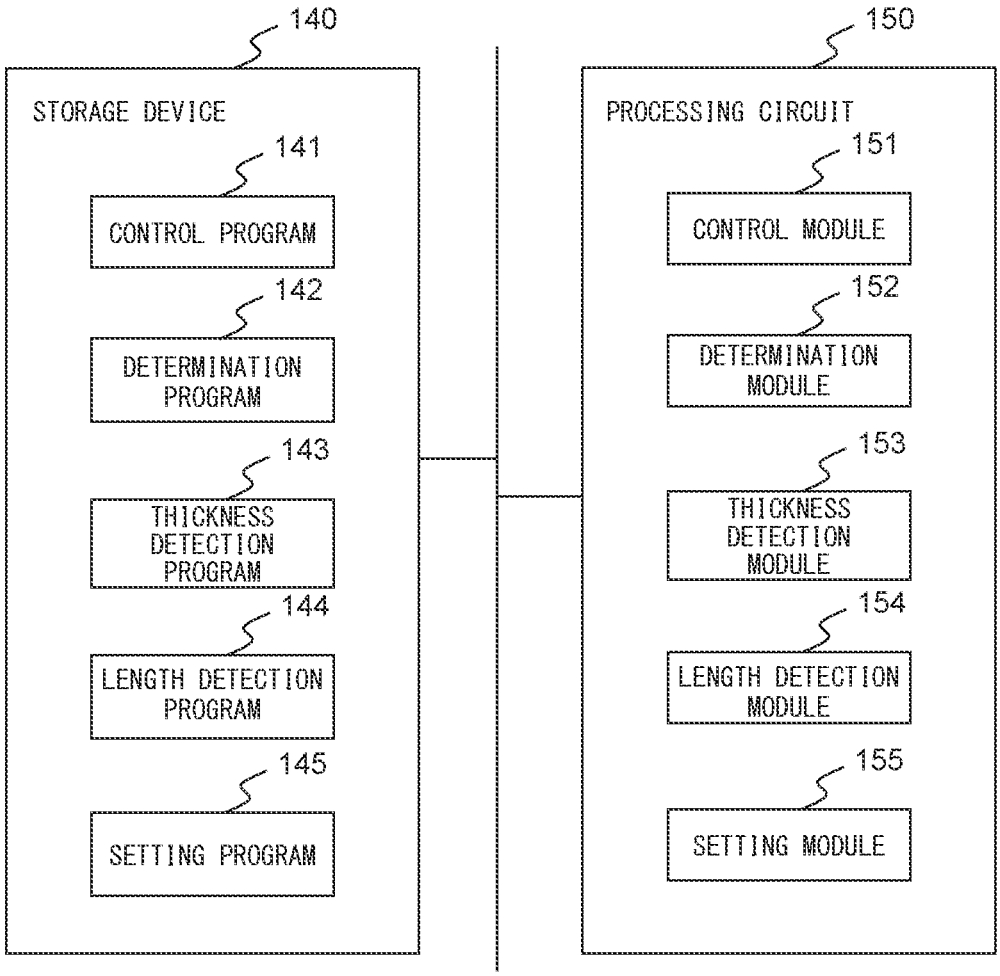
FIG. 5 is a diagram illustrating a schematic configuration of an example of a storage device and a processing circuit.

FIG. 5 is a diagram illustrating a schematic configuration of an example of a storage device and a processing circuit.

As illustrated in FIG. 5, a control program 141, a determination program 142, a thickness detection program 143, a length detection program 144, a setting program 145, etc., are stored in the storage device 140. Each program is a functional module implemented by software operating on the processor. The processing circuit 150 reads each program stored in the storage device 140 and operates in accordance with the read program. Consequently, the processing circuit 150 functions as a control module 151, a determination module 152, a thickness detection module 153, a length detection module 154, and a setting module 155.

Figure 6:
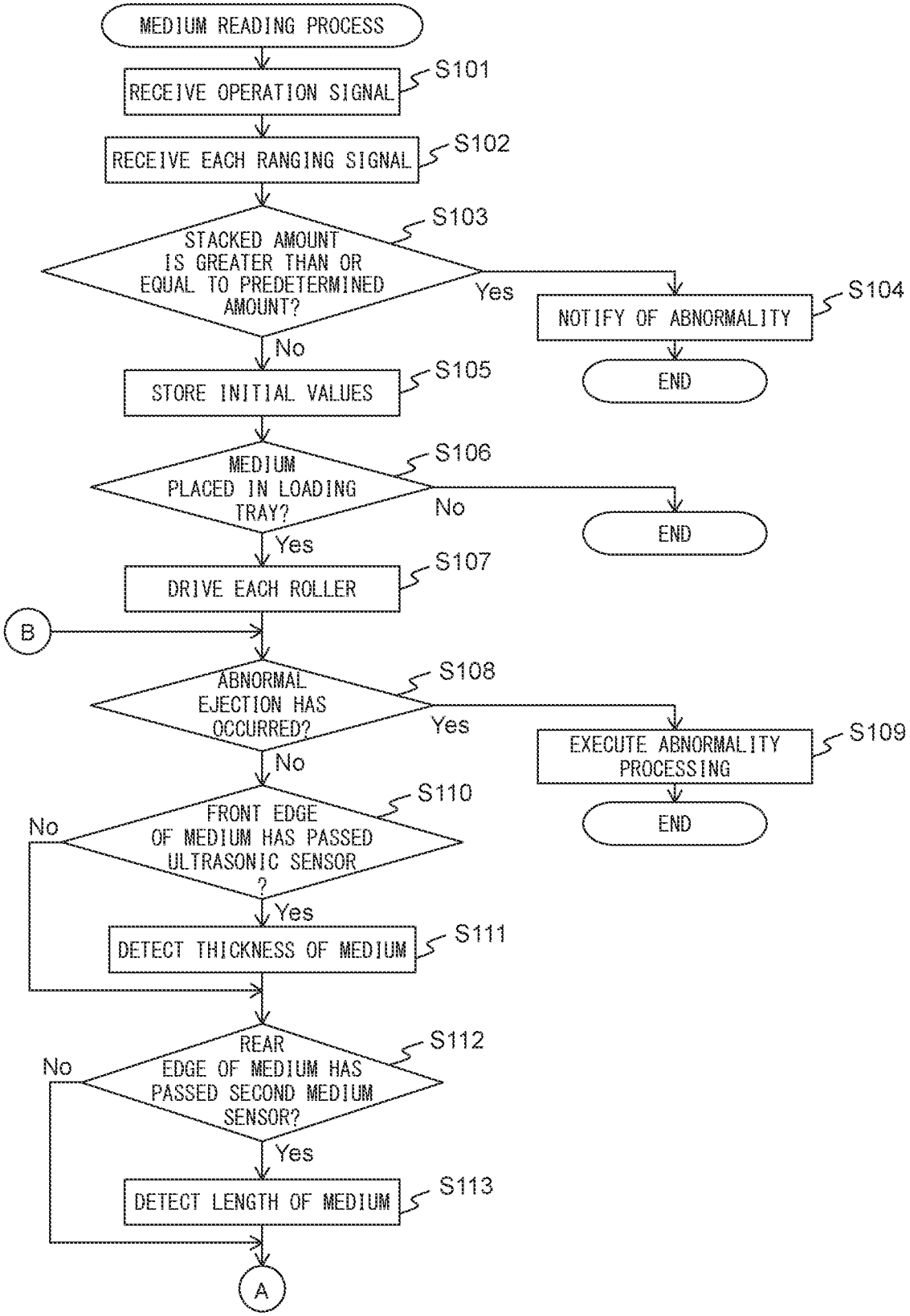
FIG. 6 is a flowchart illustrating an operation example of medium reading process.
Figure 7:
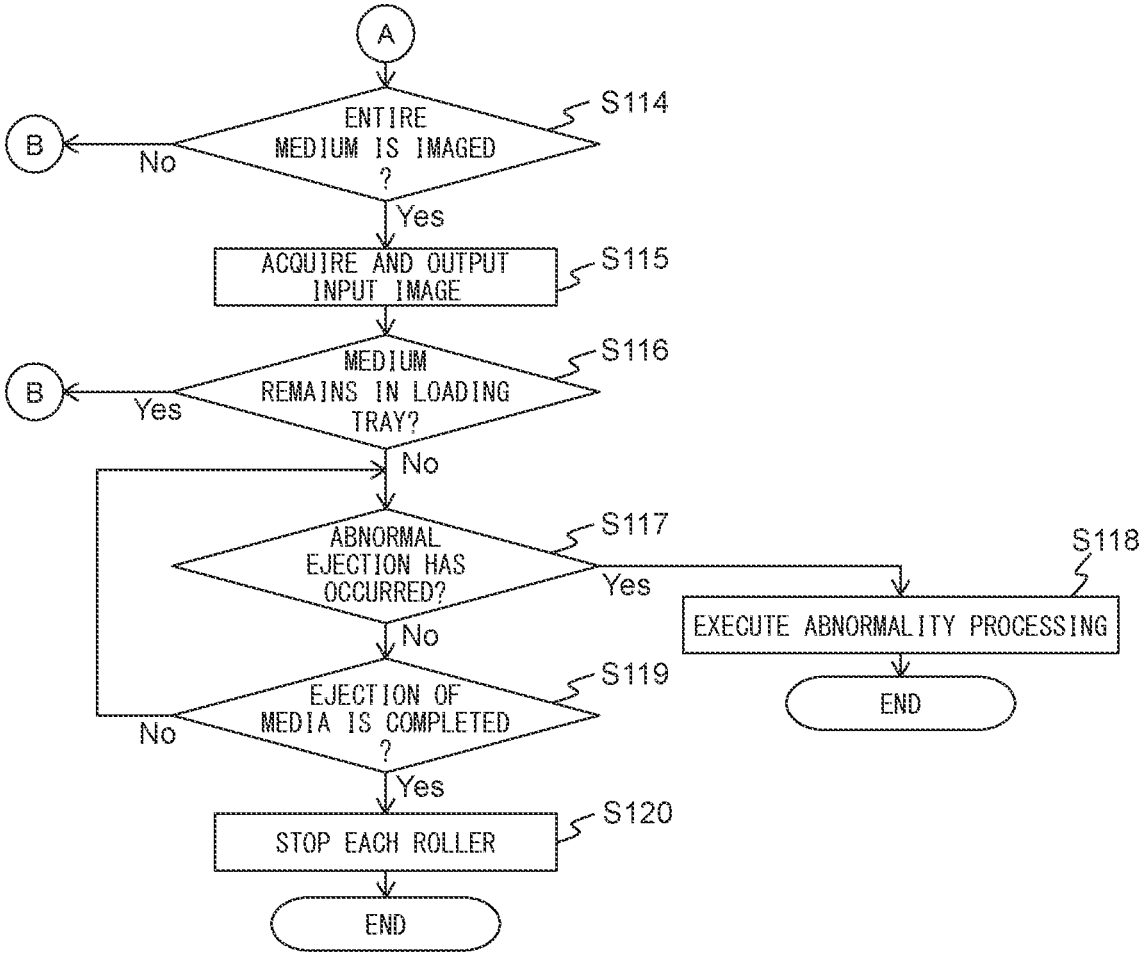
FIG. 7 is a flowchart illustrating an operation example of the medium reading process.

FIG. 6 and FIG. 7 are a flowchart illustrating an operation example of medium reading process in an example of a medium ejection apparatus.

The operation example of the medium reading process in the medium ejection apparatus 100 will be described below referring to the flowchart illustrated in FIG. 6 and FIG. 7. The operation flow described below is executed mainly by the processing circuit 150 in accordance with a program stored in advance in the storage device 140 in cooperation with the components in the medium ejection apparatus 100.

First, the control module 151 waits until an instruction to read a medium is input by a user by using the operation device 105 or the information processing apparatus and an operation signal instructing to read a medium is received from the operation device 105 or the interface device 132 (step S101).

Next, the control module 151 receives the first ranging signal, the second ranging signal, and the third ranging signal from the first range sensor 121, the second range sensor 122, and the third range sensor 123, respectively (step S102).

Next, the control module 151 determines whether a stacked amount of media stacked on the ejection tray 104 is greater than or equal to a predetermined amount based on the received first ranging signal, the received second ranging signal, and the received third ranging signal (step S103). The control module 151 determines that the stacked amount of media is greater than or equal to the predetermined amount when the signal value of the first ranging signal is less than or equal to a first reference value, when the signal value of the second ranging signal is less than or equal to a second reference value, or when the signal value of the third ranging signal is less than or equal to a third reference value. The first reference value, the second reference value, and the third reference value are respectively set to the signal values of the first ranging signal, the second ranging signal, and the third ranging signal when a stacked amount of media is the predetermined amount. The control module 151 determines that the stacked amount of media is less than the predetermined amount when the signal value of the first ranging signal is greater than the first reference value, the signal value of the second ranging signal is greater than the second reference value, and the signal value of the third ranging signal is greater than the third reference value.

When the stacked amount of media is greater than or equal to the predetermined amount, the control module 151 notifies a user of information prompting removal of media stacked on the ejection tray 104 by displaying the information on the display device 106 or transmitting the information to the information processing apparatus through the interface device 132 (step S104). Then, the control module 151 ends the series of steps.

When the stacked amount of media is less than the predetermined amount, the control module 151 stores the signal values of the received first ranging signal, the received second ranging signal, and the received third ranging signal into the storage device 140 as a first initial value, a second initial value, and a third initial value (step S105).

When the first initial value, the second initial value and/or the third initial value is greater than a preset upper limit value, the control module 151 may notify a user of that and end the medium reading process. Consequently, medium ejection apparatus 100 can suppress scattering of ejected media, for example, when the ejection tray 104 is not set or when the medium ejection apparatus 100 is installed at an edge of a desk and the landing surface of a medium is not present on the desk.

Next, the control module 151 acquires the first medium signal from the first medium sensor 111 and determines whether a medium is placed on the loading tray 103 based on the acquired first medium signal (step S106). When a medium is not placed on the loading tray 103, the control module 151 ends the series of steps.

When a medium is placed on the loading tray 103, the control module 151 drives the motor 131. The control module 151 conveys the medium by rotating the feed roller 112, the brake roller 113, the first conveyance roller 115, the second conveyance roller 116, the first ejection roller 119, and/or the second ejection roller 120 (step S107).

Next, the control module 151 determines whether the determination module 152 determines that abnormal ejection of a medium has occurred in determination process executed in parallel with the medium reading process (step S108). In the determination process, the determination module 152 determines whether abnormal ejection of a medium has occurred based on the first ranging signal, the second ranging signal, and/or the third ranging signal. Abnormal ejection of a medium includes curling of the front edge of a medium, curling of the rear edge of a medium, non-falling of the rear edge of a medium, flying out of a medium being ejected from the ejection tray 104, push-out of a medium which has been ejected by a medium being ejected, or change in the order of media stacked on the ejection tray 104. Details of the determination process will be described later.

When the determination module 152 determines that abnormal ejection of a medium has occurred in the determination process, the control module 151 executes abnormality processing (step S109) and ends the series of steps.

As the abnormality processing, the control module 151 stops conveyance and ejection of a medium by the feed roller 112, the brake roller 113, the first conveyance roller 115, the second conveyance roller 116, the first ejection roller 119, and/or the second ejection roller 120 by stopping the motor 131. The control module 151 may stop the medium reading process after ejecting a currently conveyed medium, as the abnormality processing.

The control module 151 may control the motor 131 in such a way as to reduce the conveyance speed and the ejection speed of a medium by each roller as the abnormality processing. In that case, the control module 151 continues the medium reading process instead of ending the process. The control module 151 may notify a user of information indicating that abnormal ejection of a medium has occurred by displaying the information on the display device 106 or transmitting the information to the information processing apparatus through the interface device 132, as the abnormality processing. The control module 151 may continue the medium reading process instead of ending the process in that case as well. When it is not determined that abnormal ejection of a medium has occurred in the determination processing, the control module 151 does not execute the abnormality processing.

Next, the control module 151 determines whether the front edge of the conveyed medium has passed the position of the ultrasonic sensor 114 (step S110). For example, the control module 151 determines whether the front edge of the medium has passed the position of the second medium sensor 117 based on the second medium signal received from the second medium sensor 117. The control module 151 periodically acquires the second medium signal from the second medium sensor 117. When the signal value of the second medium signal changes from a value indicating that a medium is not present to a value indicating that a medium is present, the control module 151 determines that the front edge of the medium has passed the position of the second medium sensor 117 and has passed the position of the ultrasonic sensor 114. When the front edge of the conveyed medium has not yet passed the position of the ultrasonic sensor 114, the control module 151 moves the processing to step S112.

On the other hand, when the front edge of the conveyed medium has passed the position of the ultrasonic sensor 114, the thickness detection module 153 detects the thickness of the conveyed medium (step S111). The thickness detection module 153 detects the thickness of a medium based on the ultrasonic signal received from the ultrasonic sensor 114. An ultrasonic wave being transmitted by the ultrasonic transmitter 114*a* and passing through a medium is attenuated by the medium; and an amount of attenuation of the ultrasonic wave increases as the thickness of the medium increases. The medium ejection apparatus 100 stores in advance in the storage device 140 a table that defines a relationship between the magnitude of an ultrasonic wave received by the ultrasonic receiver 114*b*, i.e., the signal value of the ultrasonic signal and the thickness of a medium. The thickness detection module 153 specifies a thickness of a medium related to the signal value of the received ultrasonic signal with reference to the table stored in the storage device 140.

The thickness detection module 153 may omit the processing in steps S110 and S111 when the thickness of the currently conveyed medium is already detected.

The thickness detection module 153 may further determine whether multi feed of media has occurred based on the ultrasonic signal received from the ultrasonic sensor 114. When a plurality of media are conveyed in a overlapped manner, an ultrasonic wave passing through the media is attenuated by an air layer between the media conveyed in a stacked manner. Accordingly, the thickness detection module 153 can determine whether multi feed of media has occurred based on whether the signal value of the ultrasonic signal is less than or equal to a multi feed threshold value. The multi feed threshold value is set to a value between the signal value of the ultrasonic signal when one sheet of paper is conveyed and the signal value of the ultrasonic signal when two sheets of paper are conveyed. When the thickness detection module 153 determines that multi feed of media has occurred, the control module 151 stops conveyance and ejection of a medium by stopping the motor 131. The control module 151 may stop the medium reading process after ejecting a currently conveyed medium. The control module 151 may control each roller in such a way as to, by driving the motor 131, reversely feed the media remaining on the conveyance path, temporarily return the media to the loading tray 103, and refeed (separate) the media. Consequently, the user does not need to reload and refeed the media on the loading tray 103; and thus the control module 151 can improve user convenience. Further, the control module 151 may notify the user of information indicating that multi feed of media has occurred by displaying the information on the display device 106 or transmitting the information to the information processing apparatus through the interface device 132.

The thickness detection module 153 may detect the thickness of a medium by using a thickness sensor other than the ultrasonic sensor 114. The thickness sensor is located at a position where the ultrasonic sensor 114 is located. The thickness sensor may be located at any position on the medium conveyance path. For example, the thickness sensor includes a pair of a light emitter and a light receiver provided on one side of the medium conveyance path and a pair of a light emitter and a light receiver provided on the other side. The reflected light sensor detects the distance between each pair and each surface of a medium based on the time elapsed after one pair emits light onto one surface of the medium until the pair receives reflected light and the time elapsed after the other pair emits light onto the other surface of the medium until the pair receives reflected light. The reflected light sensor generates a thickness signal indicating a subtracted value acquired by subtracting the detected distances from the distance between the two pairs as the thickness. The medium ejection apparatus 100 stores in advance in the storage device 140 a table that defines a relationship between the signal value of a thickness signal and the thickness of a medium. The thickness detection module 153 specifies a thickness of a medium related to the signal value of a received thickness signal with reference to the table stored in the storage device 140. The thickness sensor is not limited to a sensor using light, and any other sensor that can detect the thickness of a medium, such as a pressure sensor or a thickness sensor using a contact segment, may be used as the thickness sensor.

Next, the control module 151 determines whether the rear edge of the conveyed medium has passed the position of the second medium sensor 117 (step S112). The control module 151 determines whether the rear edge of a medium has passed the position of the second medium sensor 117 based on the second medium signal received from the second medium sensor 117. The control module 151 periodically acquires the second medium signal from the second medium sensor 117 and determines that the rear edge of a medium has passed the position of the second medium sensor 117 when the signal value of the second medium signal changes from a value indicating that a medium is present to a value indicating that a medium is not present. When the rear edge of the conveyed medium has not yet passed the position of the second medium sensor 117, the control module 151 moves the processing to step S114.

When the rear edge of the conveyed medium has passed the position of the second medium sensor 117, the length detection module 154 detects the length of the conveyed medium (step S113). For example, the length detection module 154 detects the length of a medium based on the second medium signal received from the second medium sensor 117. The length detection module 154 calculates, as the length of the medium, the distance through which the medium is moved by the rollers by driving the motor 131 after the front edge of the medium passes the position of the second medium sensor 117 until the rear edge of the medium passes the position of the second medium sensor 117. In other words, the length detection module 154 calculates, as the length of the medium, a value acquired by multiplying the conveyance speed of the medium by the time elapsed after the front edge of the medium passes the position of the second medium sensor 117 until the rear edge of the medium passes the position of the second medium sensor 117.

The length detection module 154 may omit the processing in step S113 when the length of a currently conveyed medium is already detected.

Next, the control module 151 determines whether the entire conveyed medium is imaged (step S114). The control module 151 determines that the rear edge of a medium has passed an imaging position of the imaging device 118 and the entire conveyed medium is imaged when a first predetermined time elapses after the rear edge of the medium has passed the position of the second medium sensor 117. The first predetermined time is set to a value acquired by adding a margin to the time required for a medium to move from the second medium sensor 117 to the imaging position. The control module 151 may determine that the entire conveyed medium is imaged when a predetermined time elapses after feed of the medium has been started. When the entire conveyed medium is not yet imaged, the control module 151 returns the processing to step S108 and repeats the processing in steps S108 to S114.

On the other hand, when the entire conveyed medium is imaged, the control module 151 acquires an input image from the imaging device 118 and outputs the acquired input image by transmitting the image to the information processing apparatus through the interface device 132 (step S115).

Next, the control module 151 determines whether a medium remains on the loading tray 103 based on the first medium signal received from the first medium sensor 111 (step S116). When a medium remains on the loading tray 103, the control module 151 returns the processing to step S108 and repeats the processing in steps S108 to S116.

When a medium does not remain on the loading tray 103, the control module 151 determines whether the determination module 152 determines that abnormal ejection of a medium has occurred in the determination process, similarly to the processing in step S108 (step S117).

When the determination module 152 determines that abnormal ejection of a medium has occurred in the determination process, the control module 151 executes the abnormality processing similarly to the processing in step S109 (step S118) and ends the series of steps.

Next, the control module 151 determines whether ejection of the currently conveyed medium is completed (step S119). The control module 151 determines that the rear edge of a medium has passed the position of the first ejection roller 119 and the second ejection roller 120 and ejection of the medium is completed when a second predetermined time elapses after the rear edge of the medium has passed the position of the second medium sensor 117. The second predetermined time is set to a value acquired by adding a margin to the time required for a medium to move from the second medium sensor 117 to the first ejection roller 119 and the second ejection roller 120. The control module 151 may determine that ejection of a medium is completed when a predetermined time elapses after feed of the medium has been started. When ejection of the medium is not yet completed, the control module 151 returns the processing to step S117 and repeats the processing in steps S117 to S119.

When ejection of the medium is completed, the control module 151 stops the motor 131. Consequently, the control module 151 stops the feed roller 112, the brake roller 113, the first conveyance roller 115, the second conveyance roller 116, the first ejection roller 119, and the second ejection roller 120 (step S120) and ends the series of steps.

The processing in steps S103 and S104, S110 and S111, or S112 and S113 may be omitted.

Figure 8:
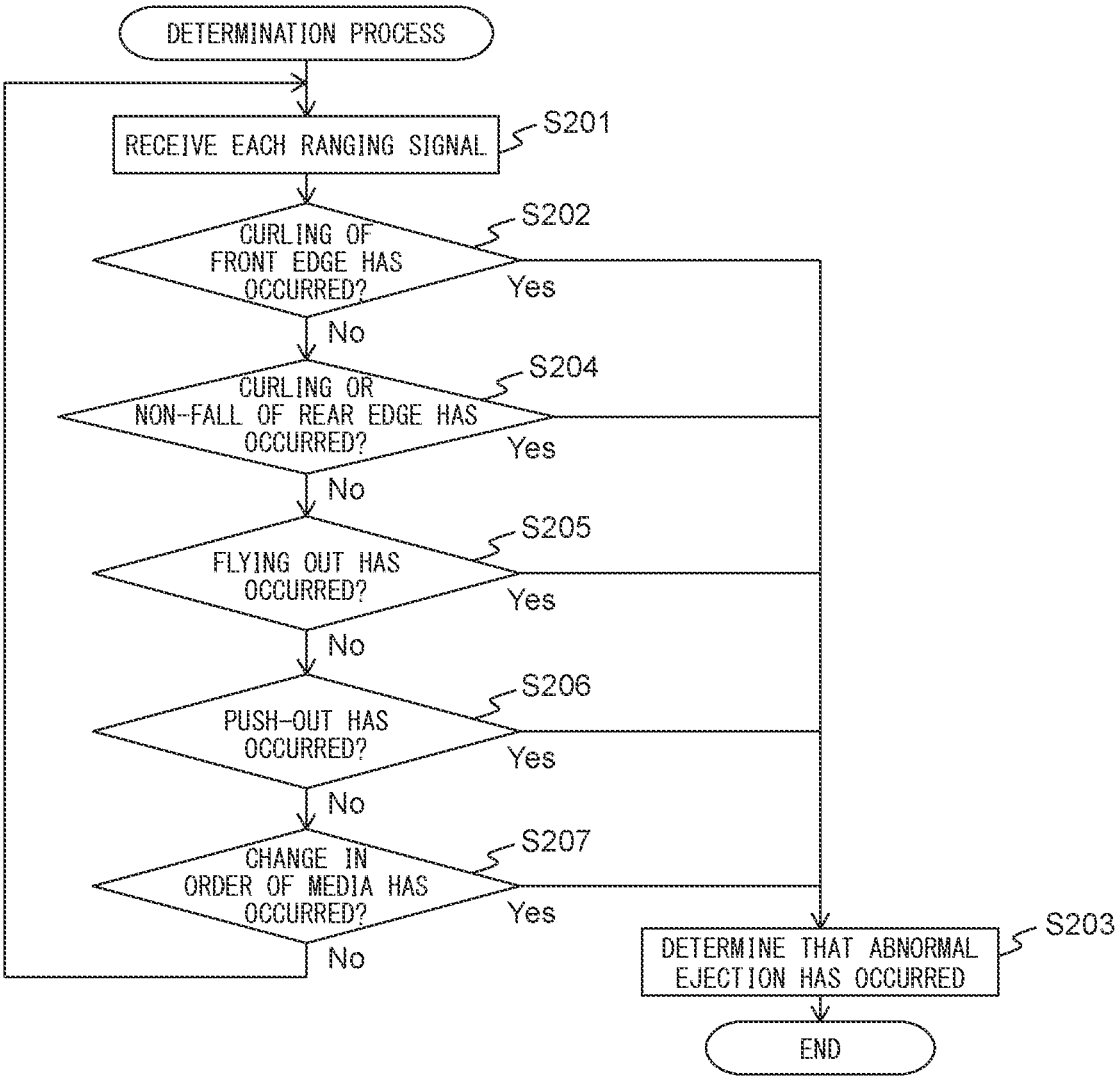
FIG. 8 is a flowchart illustrating an operation example of determination process.

FIG. 8 is a flowchart illustrating an operation example of the determination process in an example of a medium ejection apparatus.

The operation example of the determination process in the medium ejection apparatus 100 will be described below referring to the flowchart illustrated in FIG. 8. The operation flow described below is executed mainly by the processing circuit 150 in accordance with a program stored in advance in the storage device 140 in cooperation with the components in the medium ejection apparatus 100. The operation flow illustrated in FIG. 8 is executed during conveyance of a medium.

First, the determination module 152 receives the first ranging signal, the second ranging signal, and the third ranging signal from the first range sensor 121, the second range sensor 122, and the third range sensor 123, respectively (step S201). The determination module 152 calculates a subtracted value acquired by subtracting the signal value of the first ranging signal from the first initial value as a first difference value. The determination module 152 calculates a subtracted value acquired by subtracting the signal value of the second ranging signal from the second initial value as a second difference value. The determination module 152 calculates a subtracted value acquired by subtracting the signal value of the third ranging signal from the third initial value as a third difference value. The determination module 152 stores the signal value of the first ranging signal, the signal value of the second ranging signal, the signal value of the third ranging signal, the first difference value, the second difference value, and the third difference value into the storage device 140.

Next, the determination module 152 determines whether curling of the front edge of the medium has occurred based on the received first ranging signal, the received second ranging signal, and/or the received third ranging signal (step S202).

Figure 9:
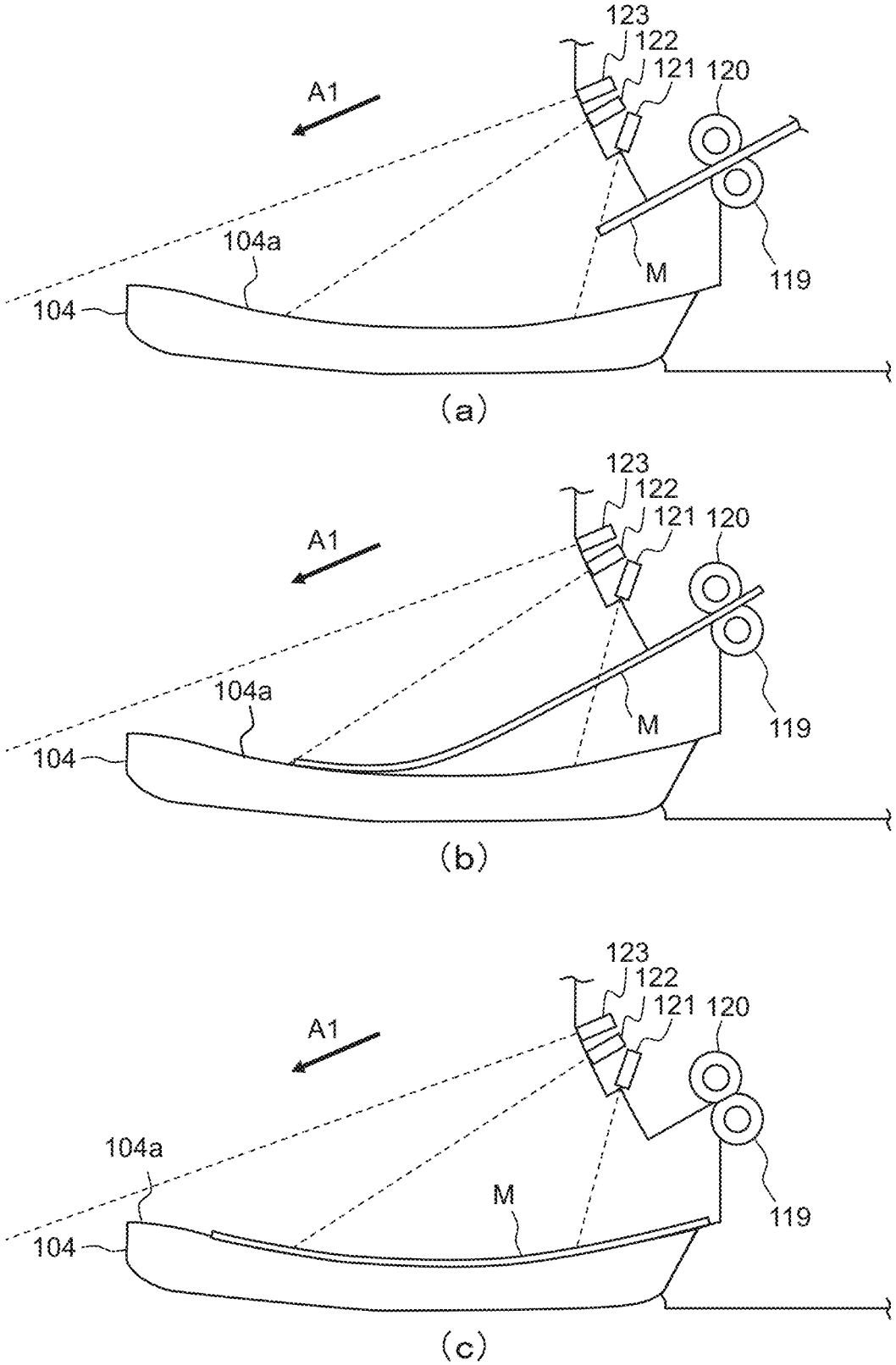
FIGS. 9(*a*) to 9(*c*) are schematic diagrams illustrating a state in which a medium is normally ejected.

FIGS. 9(*a*), 9(*b*) and 9(*c*) are schematic diagrams illustrating a state in which a medium is normally ejected without abnormal ejection of the medium. FIGS. 9(*a*), 9(*b*) and 9(*c*) illustrate an area around the ejection tray 104 of the medium ejection apparatus 100 viewed from the side. FIG. 9(*a*) illustrates a state in which the front edge of a medium M arrives at an emission range of the first range sensor 121. FIG. 9(*b*) illustrates a state in which the front edge of the medium M arrives at an emission range of the second range sensor 122. FIG. 9(*c*) illustrates a state in which ejection of the medium M is completed.

Figure 10:
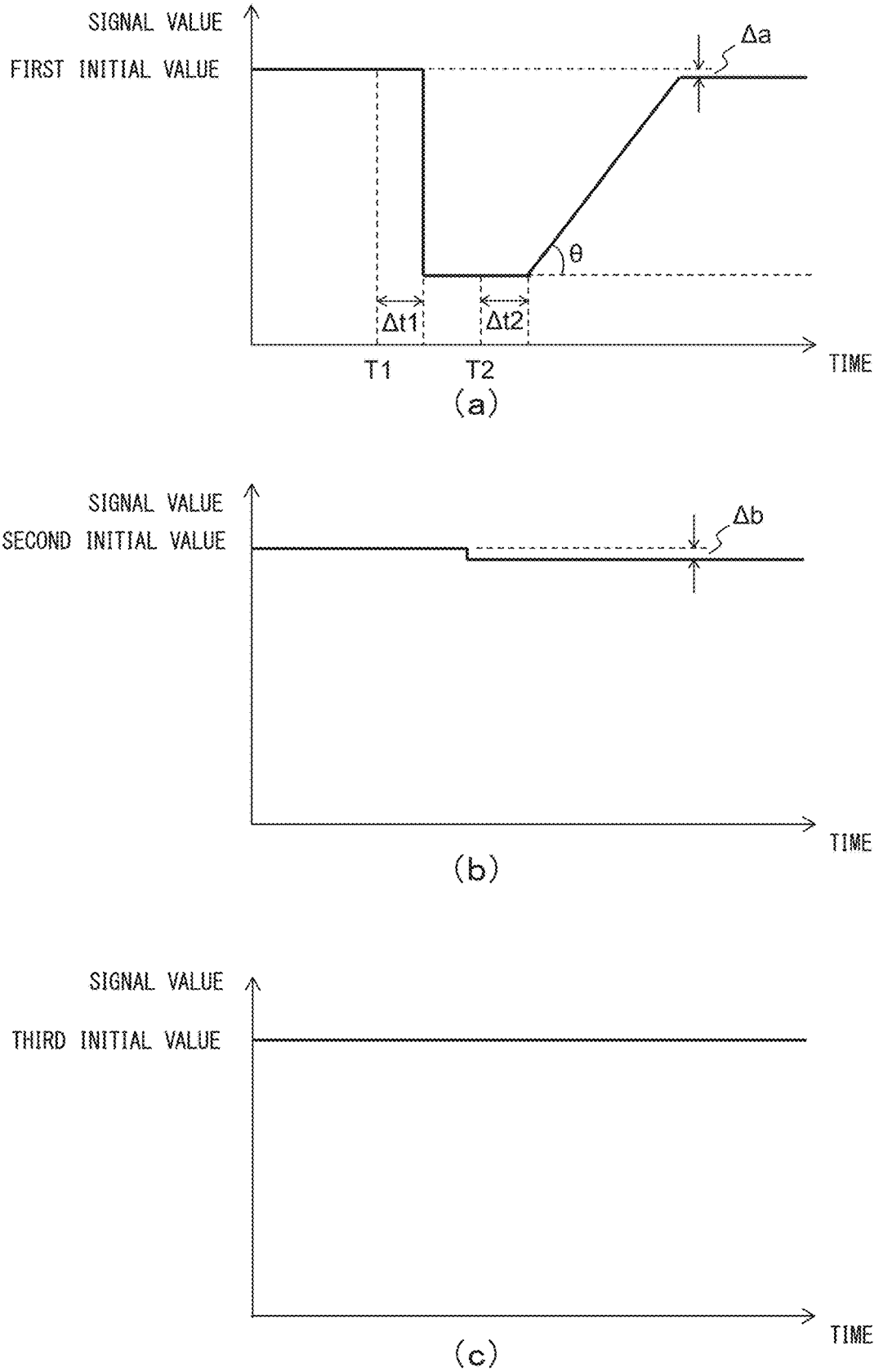
FIGS. 10(*a*) to 10(*c*) are graphs illustrating a characteristic of a ranging signal.

FIG. 10(*a*) is a graph illustrating a characteristic of the first ranging signal when a medium is normally ejected. FIG. 10(*b*) is a graph illustrating a characteristic of the second ranging signal when the medium is normally ejected. FIG. 10(*c*) is a graph illustrating a characteristic of the third ranging signal when the medium is normally ejected. In each of FIGS. 10(*a*), 10(*b*) and 10(*c*), the vertical axis indicates the signal value, and the horizontal axis indicates time.

As illustrated in FIG. 9(*a*), when the medium M is normally ejected, the front edge of the medium M arrives at the emission range of the first range sensor 121 after passing the position of the first ejection roller 119 and the second ejection roller 120. Accordingly, as illustrated in FIG. 10(*a*), when a time period Δt1 elapses after a time T1 at which the front edge of the medium M has passed the position of the second medium sensor 117, the emission range of the first range sensor 121 is blocked by the front edge of the medium M, and the signal value of the first ranging signal significantly reduces from the first initial value.

As illustrated in FIG. 9(*b*) the front edge of the medium M moves along the placement surface 104*a* of the ejection tray 104 and arrives at the emission range of the second range sensor 122. Since the front edge of the medium M moves along the placement surface 104*a*, the signal value of the second ranging signal slightly reduces from the second initial value by a difference Δb as illustrated in FIG. 10(*b*).

As illustrated in FIG. 9(*c*), the medium M free-falls by the self-weight after the rear edge of the medium M has passed the position of the first ejection roller 119 and the second ejection roller 120, and the entire medium M comes in contact with the placement surface 104*a*. Accordingly, as illustrated in FIG. 10(*a*), when a time period Δt2 elapses from a time T2 at which the rear edge of the medium M has passed the position of the second medium sensor 117, the medium M starts to move away from the first range sensor 121, and the signal value of the first ranging signal starts to increase. Since the medium M slowly falls due to an effect of air resistance, a slope θ at which the first ranging signal increases is sufficiently smaller than 90°. The signal value of the first ranging signal becomes constant when the rear edge of the medium M comes in contact with the placement surface 104*a*; and the difference Δa between the first initial value and the signal value of the first ranging signal after medium ejection is completed corresponds to the thickness of the medium M.

When the size of the medium M fits in the ejection tray 104, the front edge of the medium M does not arrive at an emission range of the third range sensor 123. Accordingly, as illustrated in FIG. 10(*c*), the signal value of the third ranging signal does not change.

Figure 11:
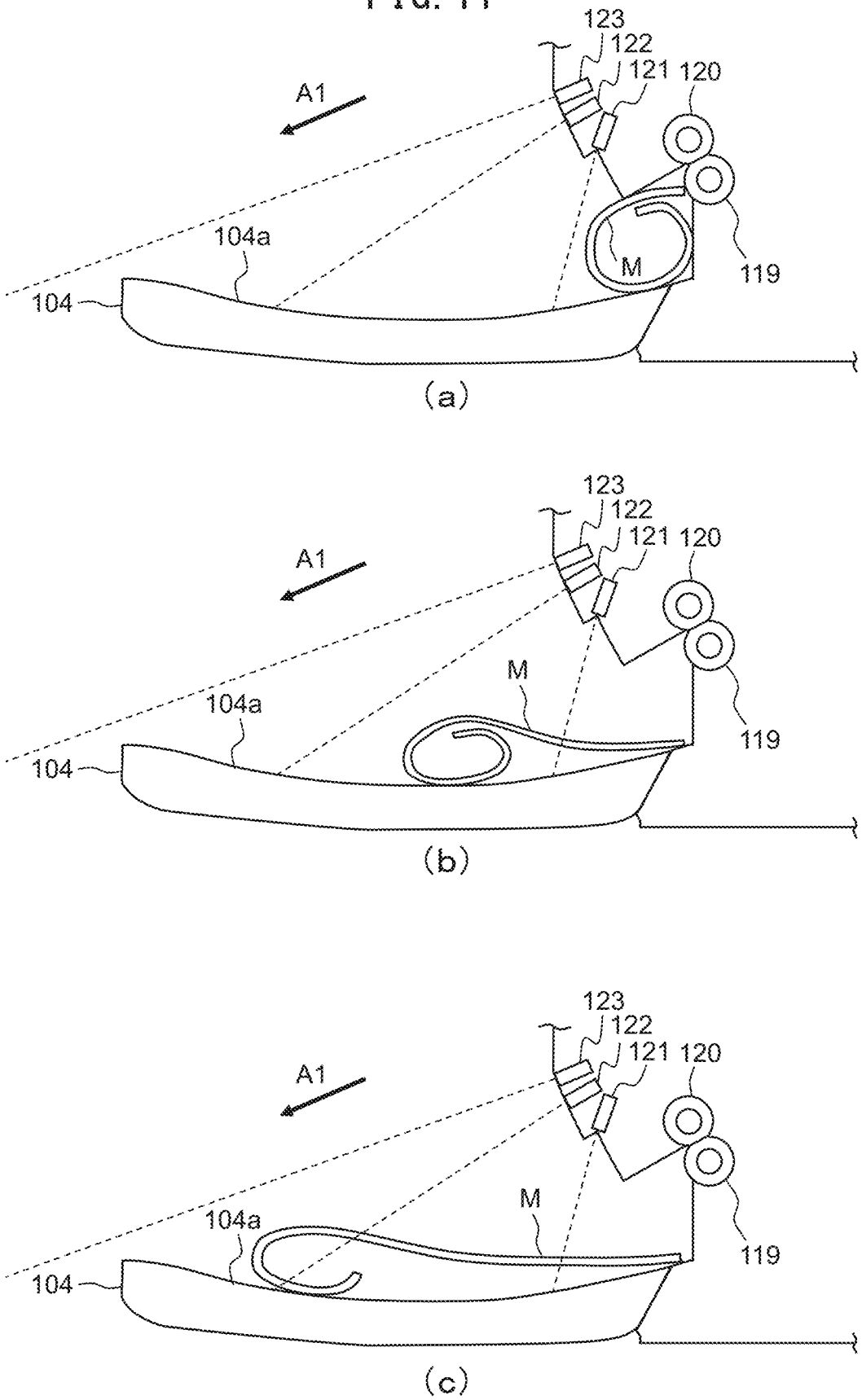
FIGS. 11(*a*) to 11(*c*) are schematic diagrams illustrating curling of a medium.

FIGS. 11(*a*), 11(*b*) and 11(*c*) are schematic diagrams illustrating curling of the front edge of a medium. FIGS. 11(*a*), 11(*b*) and 11(*c*) illustrate an area around the ejection tray 104 of the medium ejection apparatus 100 viewed from the side. FIG. 11(*a*) illustrates a state in which the front edge of a medium M is curling, and the medium M does not arrive at the emission range of the first range sensor 121. FIG. 11(*b*) illustrates a state in which the front edge of the medium M is curling, and the medium M passes the emission range of the first range sensor 121 and does not arrive at the emission range of the second range sensor 122. FIG. 11(*c*) illustrates a state in which the medium M arrives at the emission range of the second range sensor 122 with the front edge of the medium M curling.

Figure 12:
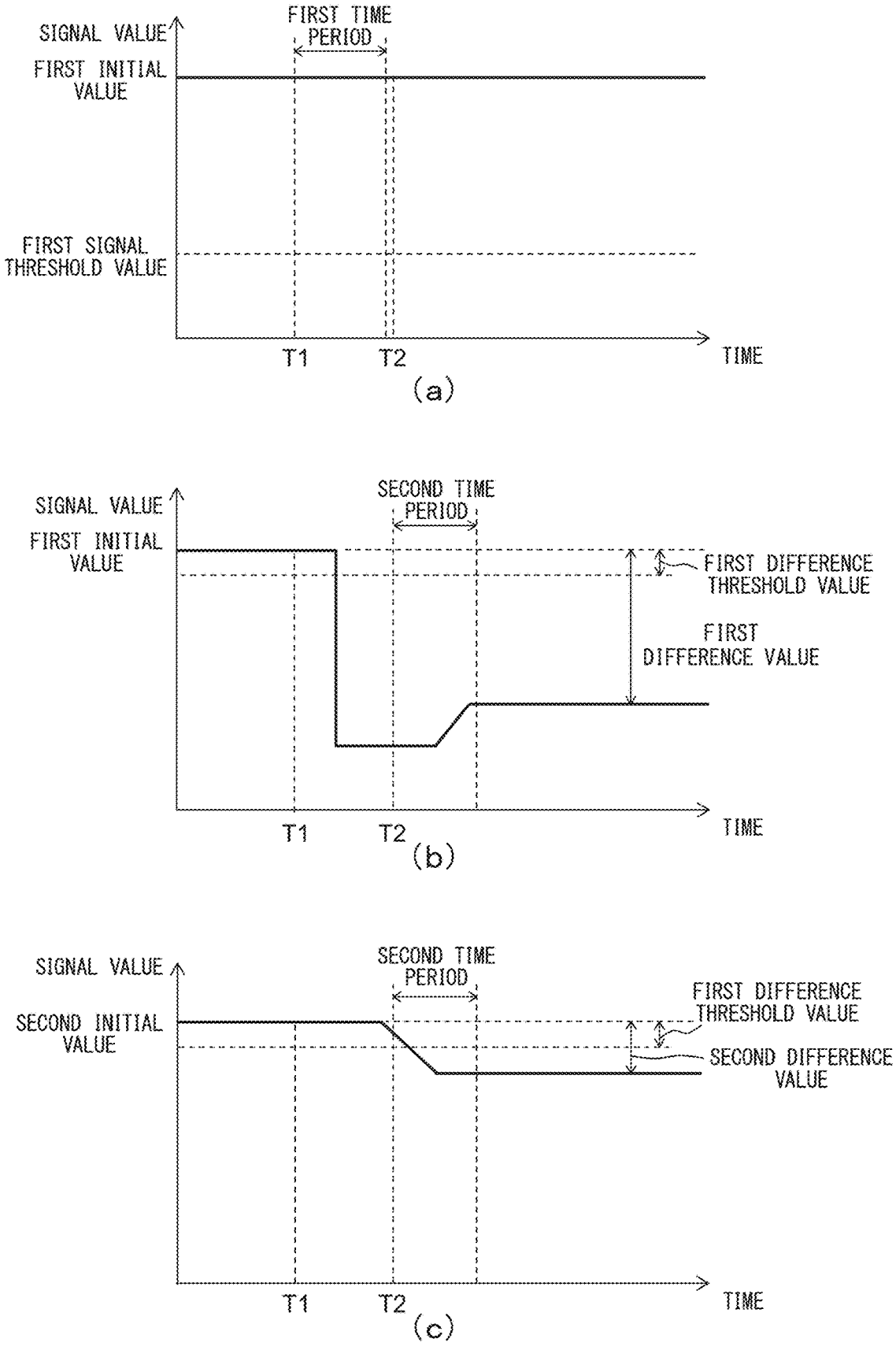
FIGS. 12(*a*) to 12(*c*) are graphs illustrating a characteristic of the ranging signal.

FIG. 12(*a*) is a graph illustrating a characteristic of the first ranging signal when the medium M with the curling front edge does not arrive at the emission range of the first range sensor 121 as illustrated in FIG. 11(*a*). FIG. 12(*b*) is a graph illustrating a characteristic of the first ranging signal when the medium M with the curling front edge passes the emission range of the first range sensor 121 and does not arrive at the emission range of the second range sensor 122 as illustrated in FIG. 11(*b*). FIG. 12(*c*) is a graph illustrating a characteristic of the second ranging signal when the medium M with the curling front edge arrives at the emission range of the second range sensor 122 as illustrated in FIG. 11(*c*). In each of FIGS. 12(*a*), 12(*b*) and 12(*c*), the vertical axis indicates the signal value, and the horizontal axis indicates time.

As illustrated in FIG. 11(*a*), the emission range of the first range sensor 121 is not blocked by the front edge of the medium M when the medium M with the curling front edge does not arrive at the emission range of the first range sensor 121. Accordingly, as illustrated in FIG. 12(*a*), the signal value of the first ranging signal does not reduce even when a certain time period elapses from the time T1 at which the front edge of the medium M has passed the position of the second medium sensor 117.

The determination module 152 determines whether each signal value of the first ranging signal acquired before an elapse of a first time period after the time T1 at which the front edge of the medium has passed the position of the second medium sensor 117 is greater than or equal to a first signal threshold value. The first time period is set to a value acquired by adding a margin to the time required for the front edge of the medium to move from the position of the second medium sensor 117 to the emission range of the first range sensor 121. The first signal threshold value is set to a value acquired by adding a margin to the signal value of the first ranging signal when the medium extends from the nip position to the placement surface 104*a* along the nip surface N of the first ejection roller 119 and the second ejection roller 120. When every signal value is greater than or equal to the first signal threshold value, the determination module 152 determines that the front edge of the medium has not arrived at the emission range of the first range sensor 121 and curling of the front edge of the medium has occurred.

On the other hand, when the medium M with the curling front edge passes the emission range of the first range sensor 121 and does not arrive at the emission range of the second range sensor 122 as illustrated in FIG. 11(*b*), the emission range of the first range sensor 121 is blocked by the medium M. In this case, while the rear edge of the medium M falls after passing the first ejection roller 119 and the second ejection roller 120, the entire medium M is lifted by the curling of the front edge, and the distance between the medium M and the first range sensor 121 becomes shorter than that under normal operation. Accordingly, as illustrated in FIG. 12(*b*), the first difference value between the first initial value and the signal value of the first ranging signal is sufficiently large even when a certain time period elapses from the time T2 at which the rear edge of the medium M has passed the position of the second medium sensor 117.

The determination module 152 determines whether the first difference value calculated for the first ranging signal acquired when a second time period elapses from the time T2 at which the rear edge of the medium has passed the position of the second medium sensor 117 is greater than or equal to a first difference threshold value. The second time period is set to a value acquired by adding a margin to the time required for the rear edge of the medium to fall to the placement surface 104 after passing the position of the second medium sensor 117. The first difference threshold value is set to a value acquired by adding a margin to a value corresponding to the total thickness of media ejected so far. When the calculated first difference value is greater than or equal to the first difference threshold value, the determination module 152 determines that the rear edge of the medium has not sufficiently fallen and curling of the front edge of the medium has occurred.

Since the emission range of the second range sensor 122 is not blocked by the medium M as illustrated in FIG. 11(*b*), the signal value of the second ranging signal does not reduce, similarly to the signal value of the first ranging signal illustrated in FIG. 12(*a*). Accordingly, the determination module 152 may determine whether curling of the front edge of the medium M has occurred based on the second ranging signal in place of or in addition to the first ranging signal.

In that case, the determination module 152 first determines whether the length of the medium is greater than or equal to a first length threshold value. The first length threshold value is set to a value acquired by adding a margin to the distance from the position of the first ejection roller 119 and the second ejection roller 120 to the emission range of the second range sensor 122. When the length of the medium is greater than or equal to the first length threshold value, the determination module 152 determines whether each second difference value calculated for the second ranging signal acquired before an elapse of a third time period from the time T1 at which the front edge of the medium has passed the position of the second medium sensor 117 is greater than or equal to the second difference threshold value. The third time period is set to a value acquired by adding a margin to the time required for the front edge of the medium to move from the position of the second medium sensor 117 to the emission range of the second range sensor 122. The second difference threshold value is set to a value acquired by subtracting a margin from a value corresponding to the total thickness of media ejected so far. When every second difference value is less than the second difference threshold value, the determination module 152 determines that the front edge of the medium has not arrived at the emission range of the second range sensor 122, and curling of the front edge of the medium has occurred.

When a long medium is ejected, the front edge of the medium may arrive at the emission range of the third range sensor 123. Accordingly, the determination module 152 may determine whether curling of the front edge of the medium has occurred based on the third ranging signal. In that case, the determination module 152 first determines whether the length of the medium is greater than or equal to a second length threshold value. The second length threshold value is set to a value acquired by adding a margin to the distance from the position of the first ejection roller 119 and the second ejection roller 120 to the emission range of the third range sensor 123. When the length of the medium is greater than or equal to the second length threshold value, the determination module 152 determines whether each signal value of the third ranging signal acquired before an elapse of a fourth time period from the time T1 at which the front edge of the medium has passed the position of the second medium sensor 117 is greater than or equal to a second signal threshold value. The fourth time period is set to a value acquired by adding a margin to the time required for the front edge of the medium to move from the position of the second medium sensor 117 to the emission range of the third range sensor 123. The second signal threshold value is set to a value acquired by adding a margin to the signal value of the third ranging signal when the medium extends on the downstream side of the ejection tray 104 along the placement surface 104*a*. When each signal value of the third ranging signal is greater than or equal to the second signal threshold value, the determination module 152 determines that the front edge of the medium has not arrived at the emission range of the third range sensor 123 and curling of the front edge of the medium has occurred.

When the medium M with the curling front edge arrives at the emission range of the second range sensor 122 as illustrated in FIG. 11(*c*), the emission range of the second range sensor 122 is blocked by the medium M. In this case, while the rear edge of the medium M falls after passing the first ejection roller 119 and the second ejection roller 120, the entire medium M is lifted by curling of the front edge, and the distance between the medium M and the second range sensor 122 decreases. Accordingly, as illustrated in FIG. 12(*c*), the second difference value between the second initial value and the signal value of the second ranging signal is sufficiently large even when a certain time period elapses after the time T2 at which the rear edge of the medium M has passed the position of the second medium sensor 117.

The determination module 152 determines whether the second difference value calculated for the second ranging signal acquired when the aforementioned second time period elapses from the time T2 at which the rear edge of the medium has passed the position of the second medium sensor 117 is greater than or equal to the first difference threshold value. When the calculated second difference value is greater than or equal to the first difference threshold value, the determination module 152 determines that the medium has not sufficiently fallen and curling of the front edge of the medium has occurred.

When the medium M with the curling front edge arrives at the emission range of the third range sensor 123, the emission range of the third range sensor 123 is blocked by the medium M, and the distance between the medium M and the third range sensor 123 decreases. Accordingly, the determination module 152 may determine whether curling of the front edge of the medium has occurred based on the third ranging signal. In that case, the determination module 152 determines whether the third difference value calculated for the third ranging signal acquired when the aforementioned second time period elapses from the time T2 at which the rear edge of the medium has passed the position of the second medium sensor 117 is greater than or equal to the first difference threshold value. When the calculated third difference value is greater than or equal to the first difference threshold value, the determination module 152 determines that the medium has not sufficiently fallen, and curling of the front edge of the medium has occurred.

When determining that curling of the front edge of the medium has occurred, the determination module 152 determines that abnormal ejection of a medium has occurred (step S203) and ends the series of steps.

When not determining that curling of the front edge of the medium has occurred, the determination module 152 determines whether curling of the rear edge of the medium or non-falling of the rear edge of the medium has occurred (step S204).

Figure 13:
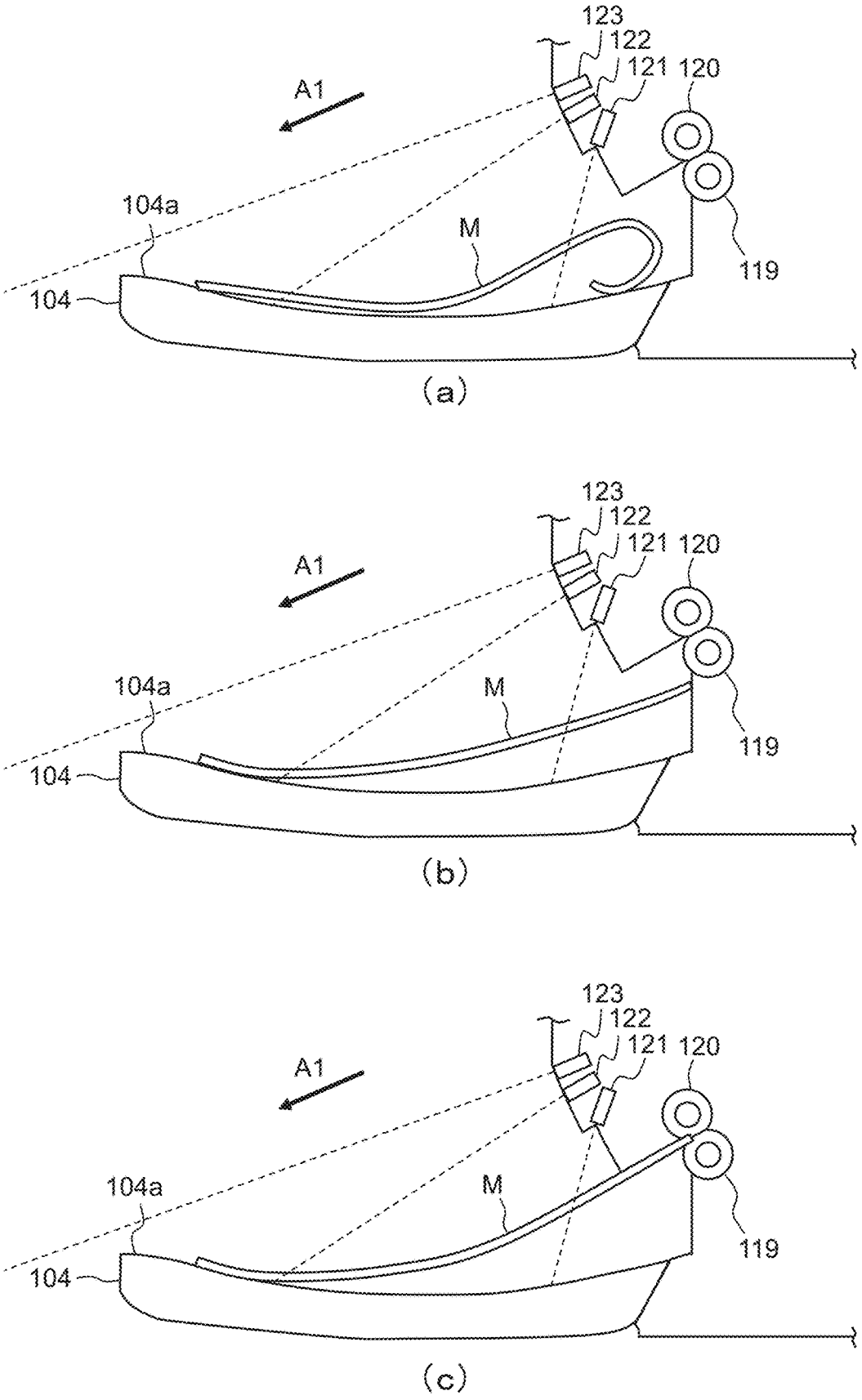
FIGS. 13(*a*) to 13(*c*) are schematic diagrams illustrating curling, etc., of a medium.

FIGS. 13(*a*), 13(*b*) and 13(*c*) are schematic diagrams illustrating curling of the rear edge of a medium or non-falling of the rear edge of a medium. FIGS. 13(*a*), 13(*b*) and 13(*c*) illustrate an area around the ejection tray 104 of the medium ejection apparatus 100 viewed from the side. FIG. 13(*a*) illustrates a state in which the rear edge of a medium M is curling. FIG. 13(*b*) illustrates a state in which the rear edge of the medium M is caught by the wall surface 101*a* and does not fall. FIG. 13(*c*) illustrates a state in which the rear edge of the medium M is caught by the first ejection roller 119 and the second ejection roller 120 and does not fall.

Figure 14:
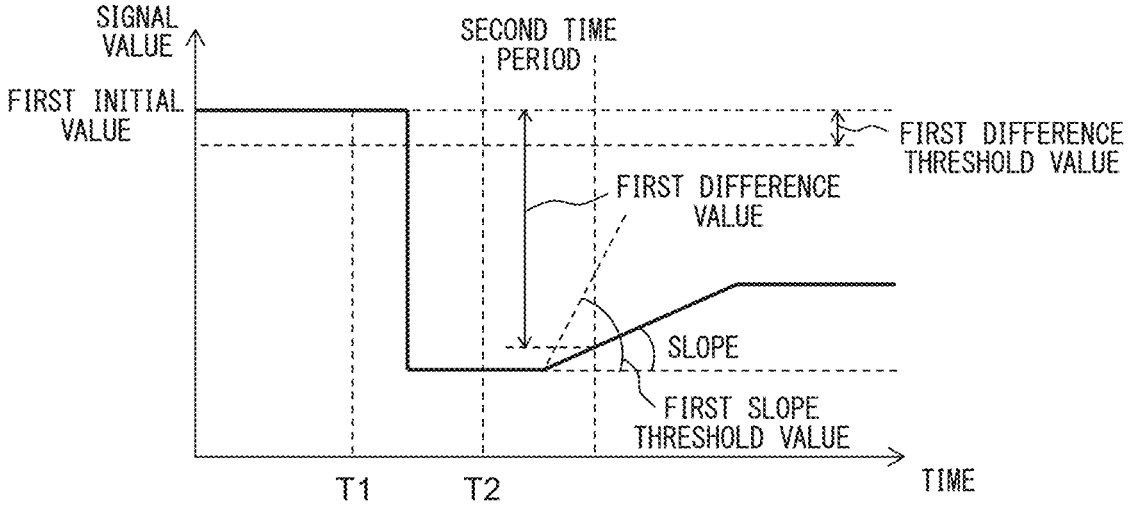
FIGS. 14(*a*) and 14(*b*) are graphs illustrating a characteristic of the ranging signal.
Figure 14:
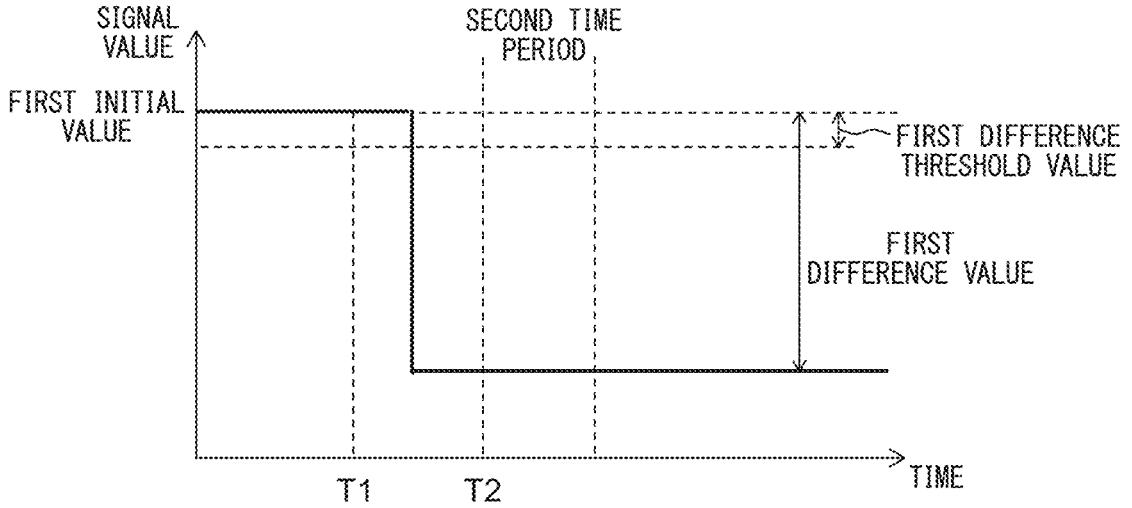

FIG. 14(*a*) is a graph illustrating a characteristic of the first ranging signal when the rear edge of the medium M is curling as illustrated in FIG. 13(*a*) or when the rear edge of the medium M is caught by the wall surface 101*a* and does not fall as illustrated in FIG. 13(*b*). FIG. 14(*b*) is a graph illustrating a characteristic of the first ranging signal when the rear edge of the medium M is caught by the first ejection roller 119 and the second ejection roller 120 and does not fall as illustrated in FIG. 13(*c*). In each of FIGS. 14(*a*) and 14(*b*), the vertical axis indicates the signal value, and the horizontal axis indicates time.

When the rear edge of the medium M is curling as illustrated in FIG. 13(*a*), the medium M descends slowly instead of free-falling due to the curling of the rear edge, after the rear edge of the medium M passes the first ejection roller 119 and the second ejection roller 120. When the rear edge of the medium M is caught by the wall surface 101*a* as illustrated in FIG. 13(*b*), the medium M descends slowly instead of free-falling due to the rear edge being caught, after the rear edge of the medium M passes the first ejection roller 119 and the second ejection roller 120. Accordingly, as illustrated in FIG. 14(*a*), a slope θ at which the first ranging signal increases after medium ejection is sufficiently smaller than that at the time of normal ejection.

The determination module 152 monitors the signal value of the first ranging signal acquired after the time T2 at which the rear edge of the medium has passed the position of the second medium sensor 117 and calculates a slope at which the signal value increases after the signal value starts to increase until the value becomes constant. The determination module 152 determines whether the calculated slope is less than or equal to a first slope threshold value and determines that the rear edge of the medium is not free-falling and curling or non-falling of the rear edge of the medium has occurred when the slope is less than or equal to the first slope threshold value. The first slope threshold value is set to a value between a slope calculated when a medium is normally ejected and a slope calculated when curling or non-falling of the rear edge of the medium has occurred through an experiment performed in advance.

The falling speed of a medium varies by the material of the medium (such as thin paper, normal paper, or thick paper) and increases as the thickness of the medium increases. Accordingly, the slope of the first ranging signal during falling of a medium increases as the thickness of the medium increases. Therefore, the first slope threshold value may be set in such a way as to increase as the thickness of an ejected medium increases. For example, the medium ejection apparatus 100 stores in advance a table that defines relationships among the signal value of the ultrasonic signal or the thickness signal, the thickness of a medium, and the first slope threshold value in the storage device 140. The determination module 152 identifies the thickness of a medium corresponding to the signal value of the received ultrasonic signal or thickness signal and a first slope threshold value by referring to the table stored in the storage device 140. Consequently, the determination module 152 can more precisely determine whether abnormal ejection of a medium has occurred.

When the rear edge of the medium M is caught by the first ejection roller 119 and the second ejection roller 120 and does not fall, as illustrated in FIG. 13(*c*), the distance between the medium M and the first range sensor 121 does not change before and after completion of medium ejection. Accordingly, as illustrated in FIG. 14(*b*), the first difference value between the first initial value and the signal value of the first ranging signal after medium ejection is sufficiently large. When the rear edge of the medium M is curling as illustrated in FIG. 13(*a*) or when the rear edge of the medium M is caught by the wall surface 101*a* as illustrated in FIG. 13(*b*), the rear edge of the medium M also does not fall before coming into contact with the placement surface 104*a*. Accordingly, as illustrated in FIG. 14(*a*), the first difference value between the first initial value and the signal value of the first ranging signal after medium ejection is sufficiently large.

Therefore, the determination module 152 may determine whether curling or non-falling of the rear edge of a medium has occurred based on the first difference value, similarly to the case of determining whether curling of the front edge of a medium has occurred. In that case, the determination module 152 determines whether the first difference value calculated for the first ranging signal acquired when the aforementioned second time period elapses from the time T2 at which the rear edge of the medium M has passed the position of the second medium sensor 117 is greater than or equal to the first difference threshold value. When the first difference value is greater than or equal to the first difference threshold value, the determination module 152 determines that curling or non-falling of the rear edge of a medium has occurred.

When determining that curling or non-falling of the rear edge of the medium has occurred, the determination module 152 determines that abnormal ejection of a medium has occurred (step S203) and ends the series of steps.

When not determining that curling or non-falling of the rear edge of the medium has occurred, the determination module 152 determines whether flying out of the medium being ejected from the ejection tray 104 has occurred (step S205).

Figure 15:
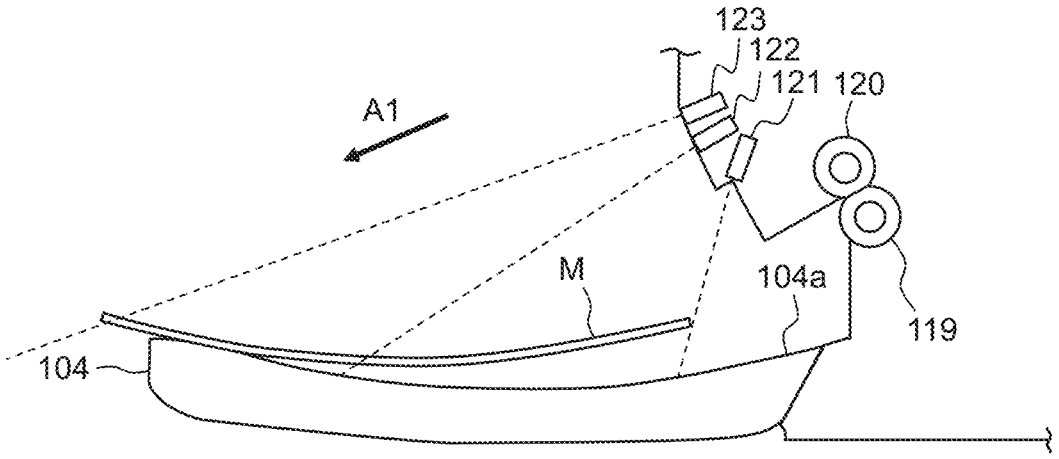
FIGS. 15(*a*) and 15(*b*) are schematic diagrams illustrating flying out of a medium.
Figure 15:
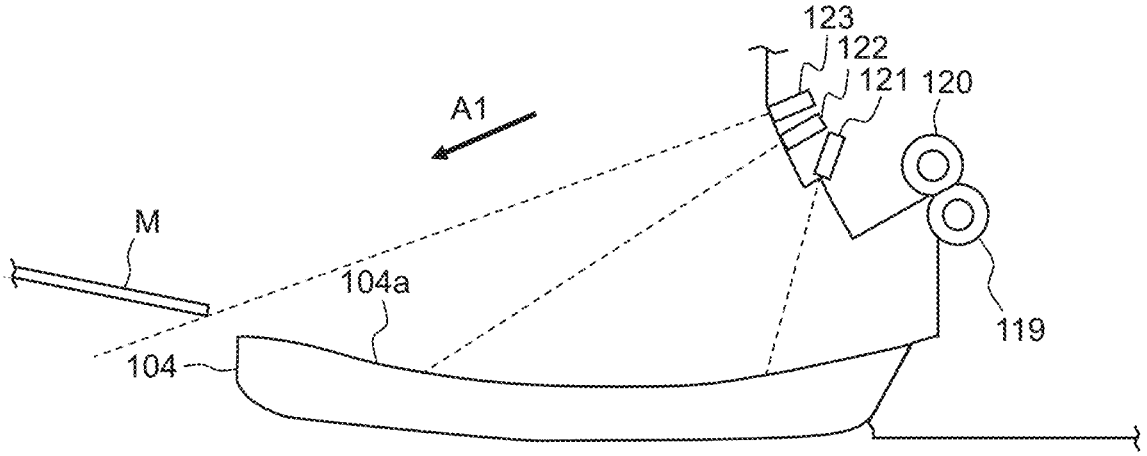

FIGS. 15(*a*) and 15(*b*) are schematic diagrams illustrating flying out of a medium. FIGS. 15(*a*) and 15(*b*) are schematic diagrams of an area around the ejection tray 104 of the medium ejection apparatus 100 viewed from the side. FIG. 15(*a*) illustrates a state in which the rear edge of a medium M passes through the emission range of the first range sensor 121. FIG. 15(*b*) illustrates a state in which the rear edge of the medium M passes through the ejection tray 104.

Figure 16:
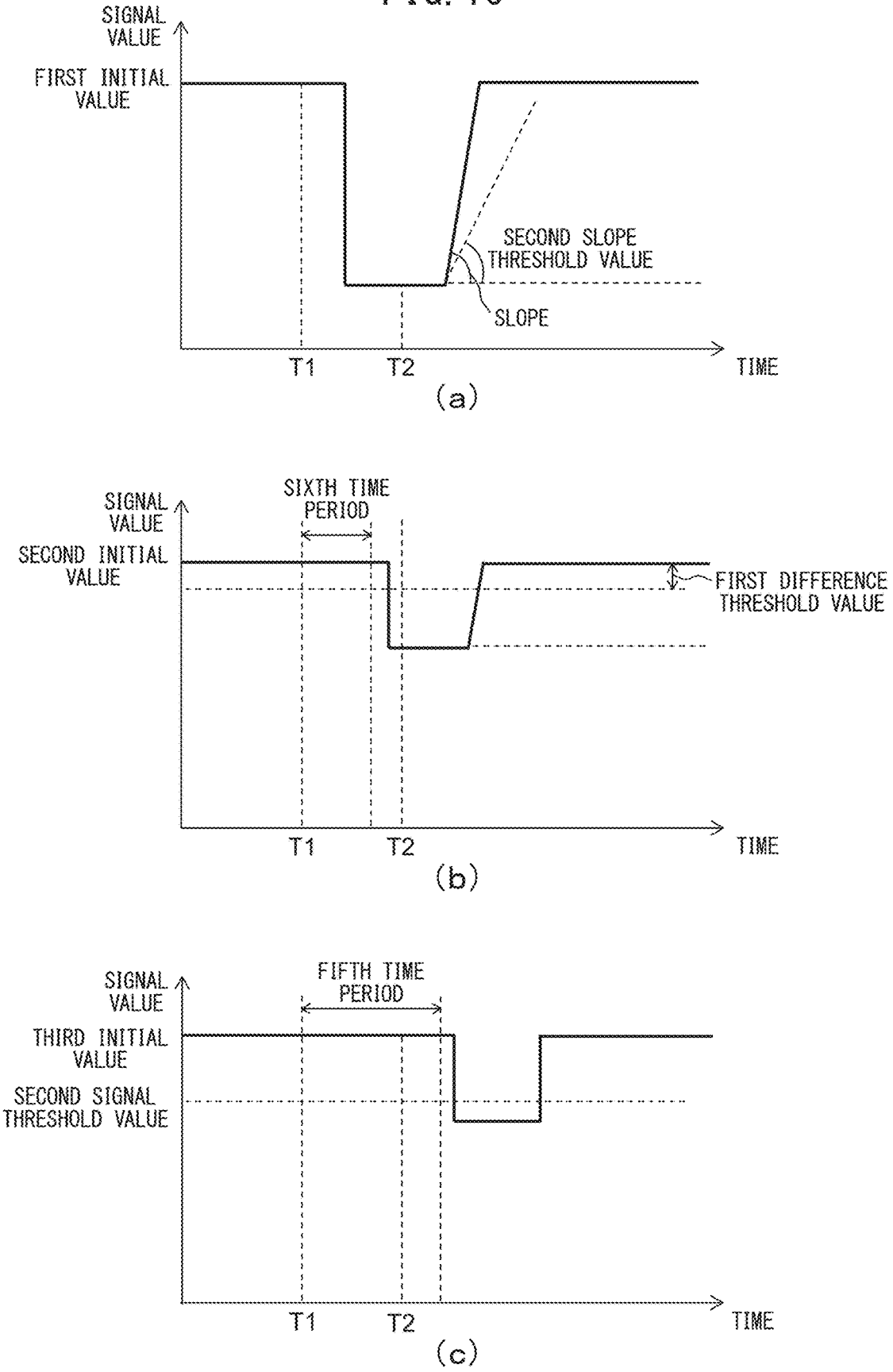
FIGS. 16(*a*) to 16(*c*) are graphs illustrating a characteristic of the ranging signal.

FIG. 16(*a*) is a graph illustrating a characteristic of the first ranging signal when flying out of a medium occurs. FIG. 16(*b*) is a graph illustrating a characteristic of the second ranging signal when flying out of a medium occurs. FIG. 16(*c*) is a graph illustrating a characteristic of the third ranging signal when flying out of a medium occurs. In each of FIGS. 16(*a*), 16(*b*) and 16(*c*), the vertical axis indicates the signal value, and the horizontal axis indicates time.

When flying out of a medium occurs as illustrated in FIG. 15(*a*), the rear edge of the medium M passes through the emission range of the first range sensor 121 after passing the first ejection roller 119 and the second ejection roller 120 before descending by free-falling. The signal value of the first ranging signal sharply increases the moment the rear edge of the medium M leaves the emission range of the first range sensor 121, and a slope at which the first ranging signal increases after medium ejection is sufficiently greater than that at the time of normal ejection, as illustrated in FIG. 16(*a*).

When flying out of a medium occurs, the medium M is ejected with force while the rear edge side of the medium M is separated from the placement surface 104*a*. Accordingly, as illustrated in FIG. 16(*b*), the signal value of the second ranging signal changes similarly to the signal value of the first ranging signal.

When flying out of a medium occurs as illustrated in FIG. 15(*b*), the medium M enters the emission range of the third range sensor 123 and subsequently leaves the emission range of the third range sensor 123. Accordingly, the signal value of the third ranging signal temporarily reduces after medium ejection and subsequently returns to a value similar to the third initial value, as illustrated in FIG. 16(*c*).

The determination module 152 determines whether each signal value of the third ranging signal acquired after the time T1 at which the front edge of the medium has passed the position of the second medium sensor 117 is greater than or equal to the aforementioned second signal threshold value. When the signal value of the third ranging signal acquired after an elapse of a fifth time period from the time T1 is less than the second signal threshold value and subsequently becomes greater than or equal to the second signal threshold value, the determination module 152 determines that flying out of a medium has occurred. The fifth time period is set to a value acquired by subtracting a margin from the time required for the front edge of the medium to move from the position of the second medium sensor 117 to the emission range of the third range sensor 123.

The determination module 152 may determine whether flying out of a medium has occurred further based on the length of the medium. In that case, the determination module 152 determines whether the length of the medium is greater than or equal to the second length threshold value. The second length threshold value is set to a value acquired by subtracting a margin from the distance from the position of the first ejection roller 119 and the second ejection roller 120 to the emission range of the third range sensor 123. The determination module 152 determines that flying out of a medium has occurred only when the signal value of the third ranging signal is less than the second signal threshold value in spite of the length of the medium being less than the second length threshold value.

Instead of determining that flying out of a medium has occurred when the aforementioned condition is satisfied, the determination module 152 may determine that flying out of a medium has occurred when another condition is further satisfied, in order to distinguish flying out from push-out of a medium to be described later. For example, when the signal value of each third ranging signal acquired before an elapse of the fifth time period from the time T2 is less than the second signal threshold value, the determination module 152 determines that push-out of a medium has occurred and flying out of a medium has not occurred.

The determination module 152 may determine whether flying out of a medium has occurred further based on the first ranging signal. In that case, the determination module 152 monitors the signal value of the first ranging signal acquired after the time T2 at which the rear edge of the medium M has passed the position of the second medium sensor 117 and calculates a slope at which the signal value increases after the signal value starts to increase until the value becomes constant. The determination module 152 determines whether the calculated slope is greater than or equal to a second slope threshold value and determines that flying out of a medium has occurred only when the slope is greater than or equal to the second slope threshold value. The second slope threshold value is set to a value between a slope calculated when a medium is normally ejected and a slope calculated when flying out of a medium has occurred through an experiment performed in advance. The second slope threshold value may be set to increase as the thickness of an ejected medium increases, similarly to the first slope threshold value. For example, the medium ejection apparatus 100 stores in advance a table that defines relationships among the signal value of the ultrasonic signal or the thickness signal, the thickness of a medium, and the second slope threshold value in the storage device 140. The determination module 152 identifies a thickness of a medium and a second slope threshold value corresponding to the signal value of the received ultrasonic signal or the received thickness signal by referring to the table stored in the storage device 140. Consequently, the determination module 152 can more precisely determine whether abnormal ejection of a medium has occurred.

The determination module 152 calculates a multiplied value acquired by multiplying the ejection speed of a medium by the time elapsed after the signal value of the first ranging signal starts to increase until the signal value of the third ranging signal starts to increase. The determination module 152 determines that flying out of a medium has occurred only when the difference between the calculated multiplied value and the distance from the emission range of the first range sensor 121 to the emission range of the third range sensor 123 is less than a threshold value.

The determination module 152 may determine whether flying out of a medium has occurred further based on the second ranging signal. In that case, the determination module 152 determines whether each second difference value calculated for the second ranging signal acquired after the time T1 at which the front edge of the medium M has passed the position of the second medium sensor 117 is greater than or equal to the first difference threshold value. The determination module 152 determines that flying out of a medium has occurred only when a second difference value calculated for the second ranging signal acquired after an elapse of a sixth time period from the time T1 is greater than or equal to the first difference threshold value and subsequently becomes less than the first difference threshold value. The sixth time period is set to a value acquired by subtracting a margin from the time required for the front edge of the medium to move from the position of the second medium sensor 117 to the emission range of the second range sensor 122. The determination module 152 may determine that flying out of a medium has not occurred when each second difference value calculated from the second ranging signal acquired before an elapse of the sixth time period from the time T1 is greater than or equal to the first difference threshold value.

When the determination module 152 determines that flying out of a medium being ejected from the ejection tray 104 has occurred, the determination module 152 determines that abnormal ejection of a medium has occurred (step S203) and ends the series of steps.

When the determination module 152 determined that that flying out of a medium being ejected from the ejection tray 104 has not occurred, the determination module 152 determines whether push-out of a medium which has been ejected by the medium being ejected has occurred (step S206).

Figure 17:
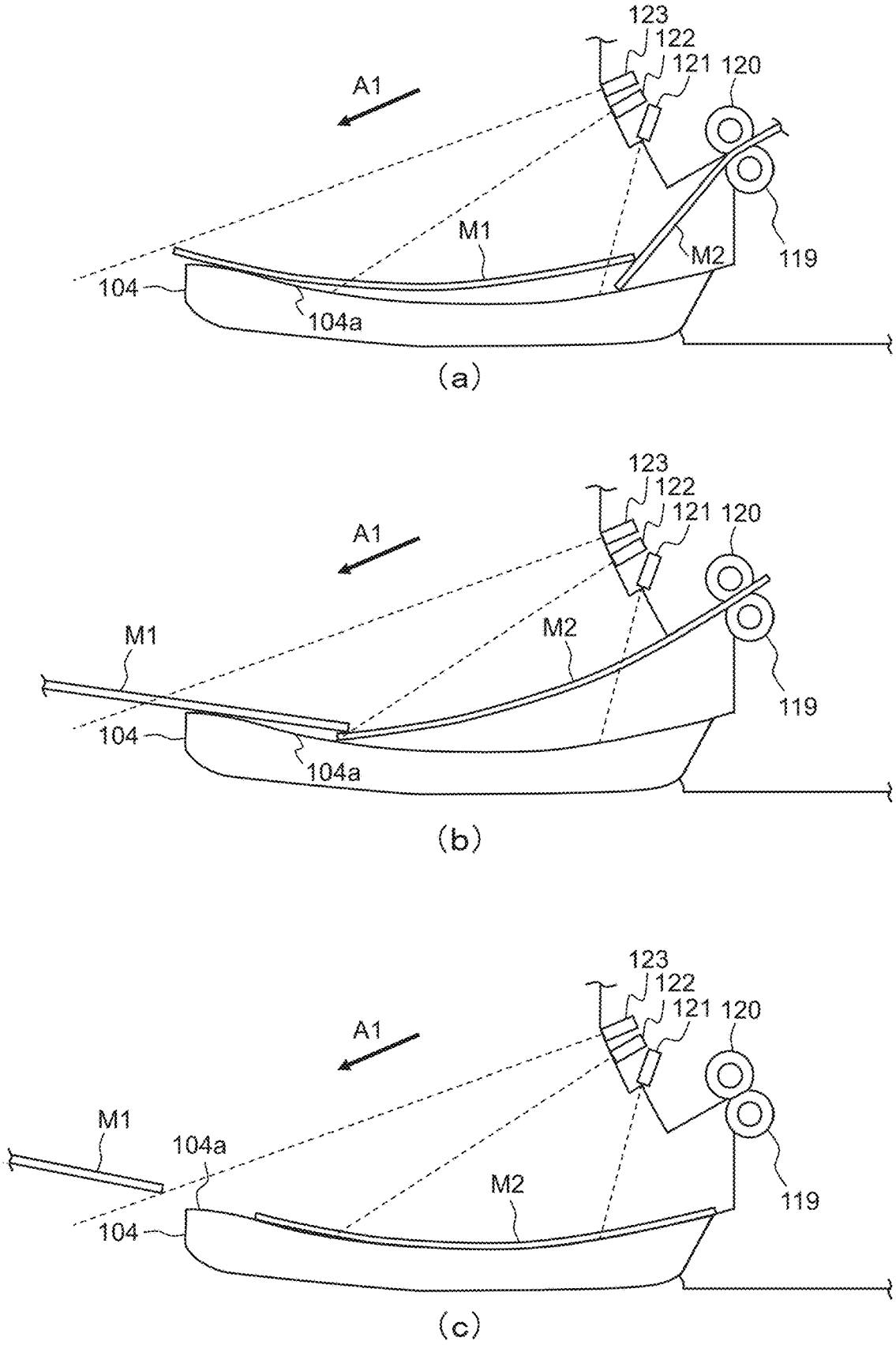
FIGS. 17(*a*) to 17(*c*) are schematic diagrams illustrating push-out of a medium.

FIGS. 17(*a*), 17(*b*) and 17(*c*) are schematic diagrams illustrating a state in which push-out of a medium occurs. FIGS. 17(*a*), 17(*b*) and 17(*c*) illustrate an area around the ejection tray 104 of the medium ejection apparatus 100 viewed from the side. FIG. 17(*a*) illustrates a state in which the front edge of a medium M2 being ejected comes in contact with the rear edge of a medium M1 which has been ejected. FIG. 17(*b*) illustrates a state in which the rear edge of the ejected medium M1 is pushed by the front edge of the medium M2 being ejected, and the medium M1 which has been ejected is moving. FIG. 17(*c*) illustrates a state in which the medium M1 which has been ejected is pushed out of the ejection tray 104 by the medium M2 being ejected.

Figure 18:
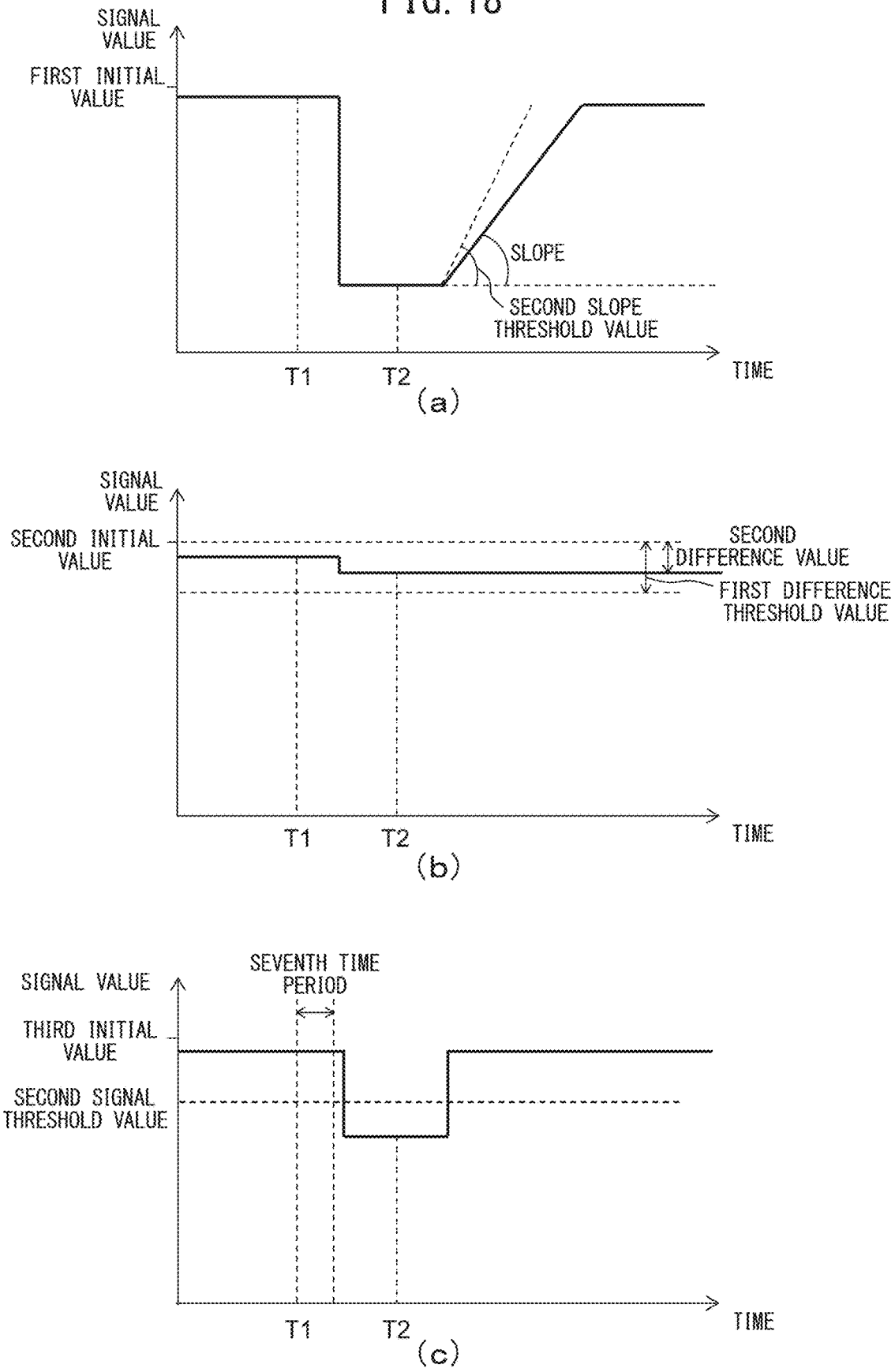
FIGS. 18(*a*) to 18(*c*) are graphs illustrating a characteristic of the ranging signal.

FIG. 18(*a*) is a graph illustrating a characteristic of the first ranging signal when push-out of a medium occurs. FIG. 18(*b*) is a graph illustrating a characteristic of the second ranging signal when push-out of a medium occurs. FIG. 18(*c*) is a graph illustrating a characteristic of the third ranging signal when a push-out of a medium occurs. In each of FIGS. 18(*a*), 18(*b*) and 18(*c*), the vertical axis indicates the signal value, and the horizontal axis indicates time.

As illustrated in FIG. 17(*a*), push-out of a medium occurs by the rear edge of the medium M1 which has been ejected being pushed by the front edge of the medium M2 being ejected. Therefore, the medium M1 which has been ejected moves in the emission range of the second range sensor 122 immediately after the front edge of the medium M2 being ejected passes the first ejection roller 119 and the second ejection roller 120, and the front edge of the medium M1 which has been ejected enters the emission range of the third range sensor 123. Subsequently, the medium M1 which has been ejected is pushed and moved by the medium M2 being ejected as illustrated in FIG. 17(*b*) and protrudes from the ejection tray 104 as illustrated in FIG. 17(*c*). The medium M2 being ejected free-falls by the self-weight similarly to a medium at the time of normal ejection, and the entire medium M2 comes in contact with the placement surface 104*a*.

Accordingly, the signal value of the first ranging signal when push-out of a medium occurs changes similarly to the signal value of the first ranging signal when a medium is ejected normally as illustrated in FIG. 18(*a*).

The signal value of the second ranging signal when push-out of a medium occurs changes similarly to the signal value of the second ranging signal when a medium is ejected normally as illustrated in FIG. 18(*b*). However, the timing at which the signal value of the second ranging signal reduces is sufficiently earlier than the timing at which the signal value of the second ranging signal reduces at the time of normal ejection.

The signal value of the third ranging signal when push-out of a medium occurs temporarily reduces during ejection of the medium M2 and subsequently returns to a value similar to the third initial value, as illustrated in FIG. 18(*c*). However, the timing at which the signal value of the third ranging signal reduces is sufficiently earlier than the timing at which the signal value of the third ranging signal reduces when protrusion of a medium occurs.

The determination module 152 determines whether each signal value of the third ranging signal acquired after the time T1 at which the front edge of the medium has passed the position of the second medium sensor 117 is greater than or equal to the aforementioned second signal threshold value. The determination module 152 determines that push-out of a medium has occurred when the signal value of the third ranging signal acquired after an elapse of a seventh time period from the time T1 and before an elapse of the fifth time period is less than the second signal threshold value and subsequently becomes greater than or equal to the second signal threshold value. The seventh time period is set to a value less than the aforementioned fifth time period and is set to a value acquired by subtracting a margin from the time required for the front edge of the medium to arrive at the placement surface 104*a* after passing the position of the second medium sensor 117.

Instead of determining that push-out of a medium has occurred when the aforementioned condition is satisfied, the determination module 152 may determine that push-out of a medium has occurred when another condition is further satisfied, in order to distinguish push-out from protrusion of a medium. For example, the determination module 152 determines whether push-out of a medium has occurred further based on the length of the medium. In that case, the determination module 152 determines whether the length of the medium is greater than or equal to a third length threshold value. The third length threshold value is set to a value less than the second length threshold value and is set to, for example, ½ of the value of the second length threshold value. The determination module 152 determines that push-out of a medium has occurred only when the signal value of the third ranging signal is less than the second signal threshold value in spite of the length of the medium being less than the third length threshold value.

The determination module 152 may determine whether push-out of a medium has occurred further based on the first ranging signal. In that case, the determination module 152 determines that push-out of a medium has occurred only when a slope at which the signal value of the first ranging signal increases after the signal value starts to increase until the signal value becomes constant is less than the second slope threshold value.

The determination module 152 calculates a multiplied value acquired by multiplying the ejection speed of a medium by the time elapsed after the signal value of the first ranging signal starts to increase until the signal value of the third ranging signal starts to increase. The determination module 152 determines that push-out of a medium has occurred only when the difference between the calculated multiplied value and the distance from the emission range of the first range sensor 121 to the emission range of the third range sensor 123 is greater than or equal to a threshold value.

The determination module 152 may determine whether push-out of a medium has occurred further based on the second ranging signal. For example, the determination module 152 determines that push-out of a medium has occurred only when each second difference value calculated for the second ranging signal acquired after the time T1 at which the front edge of the medium M has passed the position of the second medium sensor 117 does not exceed the first difference threshold value.

The determination module 152 may determine whether push-out of a medium has occurred further based on the length of a medium. For example, the determination module 152 determines whether the length of the medium is greater than or equal to a fourth length threshold value. The fourth length threshold value is set to a value acquired by subtracting a margin from the distance from the position of the first ejection roller 119 and the second ejection roller 120 to the emission range of the second range sensor 122. The determination module 152 determines that push-out of a medium has occurred only when a second difference value calculated for the second ranging signal acquired before an elapse of the aforementioned sixth time period from the time T1 is greater than or equal to the first difference threshold value in spite of the length of the medium being less than the fourth length threshold value.

When the determination module 152 determines that push-out of an ejected medium by a medium being ejected has occurred, the determination module 152 determines that abnormal ejection of a medium has occurred (step S203) and ends the series of steps.

When the determination module 152 determines that push-out of a medium which has been ejected by a medium being ejected has not occurred, the determination module 152 determines whether change in the order of media stacked on the ejection tray 104 has occurred (step S207).

Figure 19:
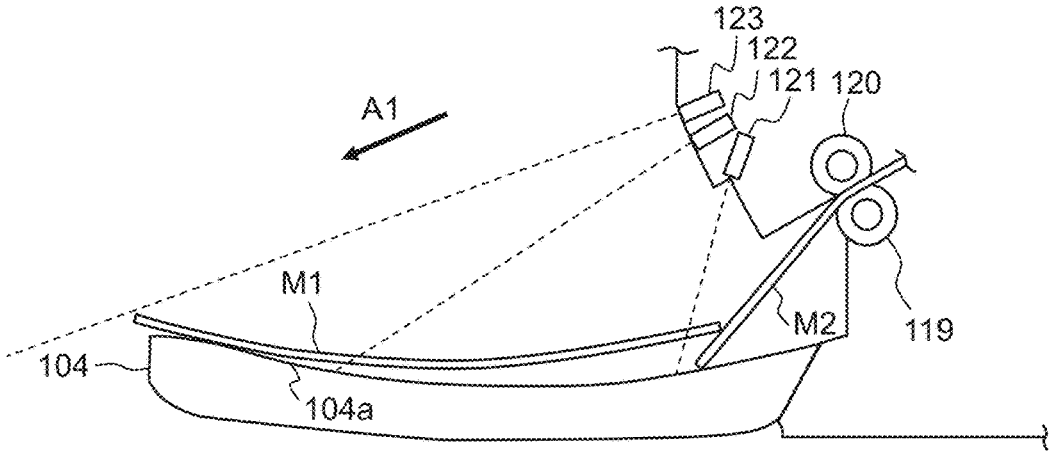
FIGS. 19(*a*) to 19(*c*) are schematic diagrams illustrating change in the order of media.
Figure 19:
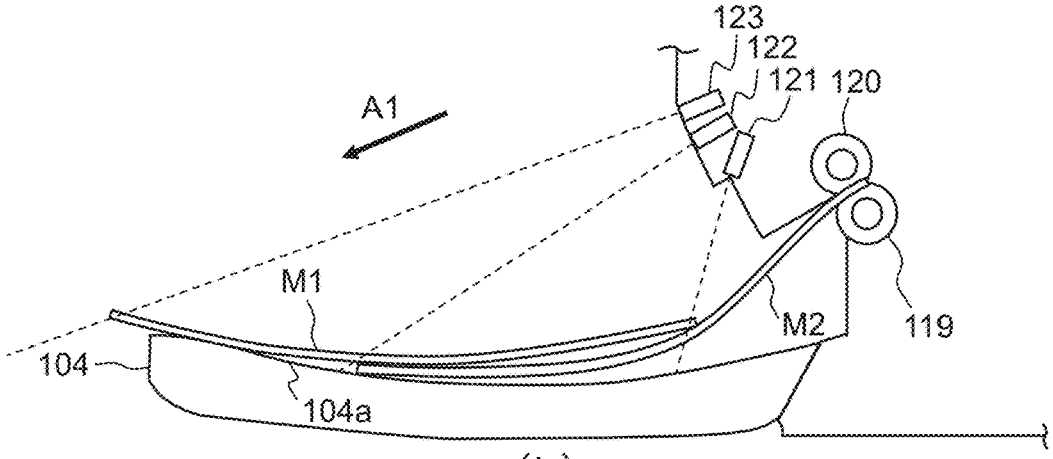
Figure 19:
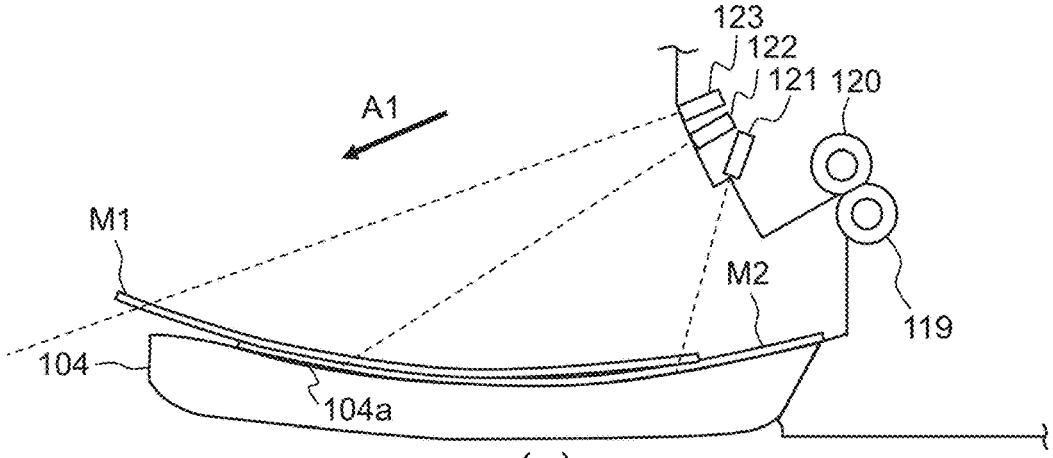

FIGS. 19(*a*), 19(*b*) and 19(*c*) are schematic diagrams illustrating change in the order of media. FIGS. 19(*a*), 19(*b*) and 19(*c*) illustrate an area around the ejection tray 104 of the medium ejection apparatus 100 viewed from the side. FIG. 19(*a*) illustrates a state in which the front edge of a medium M2 being ejected crawls under the rear edge of a medium M1 which has been ejected. FIG. 19(*b*) illustrates a state in which the medium M2 being ejected travels under the medium M1 which has been ejected and the medium M1 which has been ejected is slightly pushed out to the downstream side. FIG. 19(*c*) illustrates a state in which change in the order of media has occurred.

Figure 20:
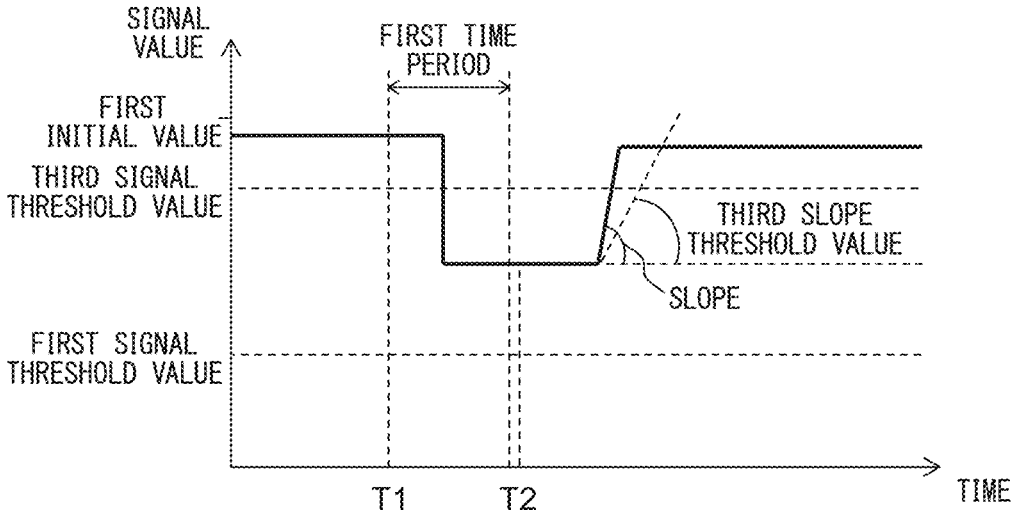
FIGS. 20(*a*) and 20(*b*) are graphs illustrating a characteristic of the ranging signals.
Figure 20:
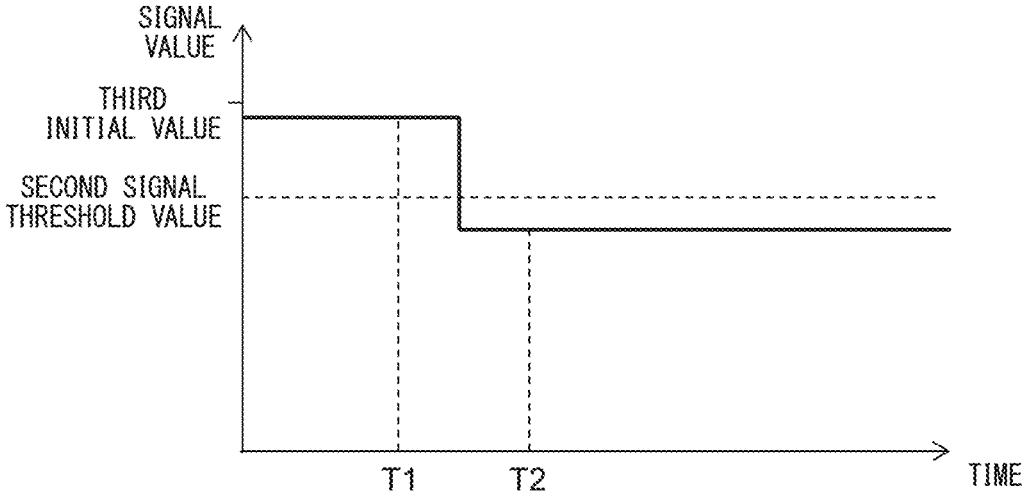

FIG. 20(*a*) is a graph illustrating a characteristic of the first ranging signal when change in the order of media occurs. FIG. 20(*b*) is a graph illustrating a characteristic of the third ranging signal when change in the order of media occurs. In each of FIGS. 20(*a*) and 20(*b*), the vertical axis indicates the signal value, and the horizontal axis indicates time.

As illustrated in FIG. 19(*a*), change in the order of media occurs by the medium M2 being ejected crawling under the medium M1 which has been ejected. Accordingly, when change in the order of media occurs, the medium M1 which has been ejected is lifted by the medium M2 being ejected. Therefore, when change in the order of media occurs, the distance from the first range sensor 121 to the medium (the medium M1 which has been ejected) is longer than the distance from the first range sensor 121 to the medium (the medium being ejected) when a medium is ejected normally.

As illustrated in FIGS. 19(*b*) and 19(*c*), the medium M1 which has been ejected is moved by the medium M2 being ejected and tends to protrude from the ejection tray 104. Further, after the rear edge of the medium M2 being ejected passes the first ejection roller 119 and the second ejection roller 120, the medium M2 being ejected is pressed down by the medium M1 which has been ejected and placed thereon, and therefore the descending speed of the medium tends to be higher than when a medium is ejected normally.

Accordingly, when change in the order of media occurs, an amount of reduction in the signal value of the first ranging signal when a certain time period elapses from the time T1 at which the front edge of the medium M has passed the position of the second medium sensor 117 is smaller than when a medium is ejected normally, as illustrated in FIG. 20(*a*). Further, a slope at which the first ranging signal increases after medium ejection is greater than when a medium is ejected normally.

When change in the order of media occurs, the signal value of the third ranging signal reduces after medium ejection and does not return afterwards, as illustrated in FIG. 20(*b*).

The determination module 152 determines whether each signal value of the first ranging signal acquired before an elapse of the aforementioned first time period from the time T1 at which the front edge of the medium has passed the position of the second medium sensor 117 is greater than or equal to the first signal threshold value and whether the signal value is less than or equal to a third signal threshold value. The third signal threshold value is set to a value greater than the first signal threshold value and, for example, is set to a value acquired by adding a margin to the signal value of the first ranging signal when change in the order of media occurs through an experiment performed in advance. The determination module 152 determines that change in the order of media has occurred when any signal value is greater than or equal to the first signal threshold value and less than or equal to the third signal threshold value. The determination module 152 may determine that change in the order of media has occurred when an event that the signal value of the first ranging signal is greater than or equal to the first signal threshold value and less than or equal to the third signal threshold value occurred a predetermined number of times or more in a row.

The determination module 152 may determine whether change in the order of media has occurred further based on the slope of the first ranging signal. In that case, the determination module 152 monitors the signal value of the first ranging signal acquired after the time T2 at which the rear edge of the medium M has passed the position of the second medium sensor 117 and calculates a slope at which the signal value increases after the signal value starts to increase until the value becomes constant. The determination module 152 determines whether the calculated slope is greater than or equal to a third slope threshold value and determines that change in the order of media has occurred only when the slope is greater than or equal to the third slope threshold value. The third slope threshold value is set to a value between a slope calculated when the medium is normally ejected and a slope calculated when change in the order of media occurs through an experiment performed in advance. The third slope threshold value may be set to increase as the thickness of an ejected medium increases, similarly to the first slope threshold value. For example, the medium ejection apparatus 100 stores in advance a table that defines relationships among the signal value of the ultrasonic signal or the thickness signal, the thickness of a medium, and the third slope threshold value in the storage device 140. The determination module 152 identifies a thickness of a medium and a third slope threshold value that are related to the signal value of the received ultrasonic signal or the received thickness signal by referring to the table stored in the storage device 140. Consequently, the determination module 152 can more precisely determine whether abnormal ejection of a medium has occurred.

The determination module 152 may determine whether change in the order of media has occurred further based on the third ranging signal. In that case, the determination module 152 determines whether each signal value of the third ranging signal acquired after the time T1 at which the front edge of the medium has passed the position of the second medium sensor 117 is greater than or equal to the second signal threshold value. The determination module 152 determines that change in the order of media has occurred only when the signal value of the third ranging signal is less than the second signal threshold value and does not become greater than or equal to the second signal threshold value afterwards.

When the determination module 152 determines that change in the order of media has occurred, the determination module 152 determines that abnormal ejection of a medium has occurred (step S203) and ends the series of steps. When the determination module 152 determines that change in the order of media has not occurred, the determination module 152 returns the processing to step S201 and repeats the processing in steps S201 to S207.

Thus, the determination module 152 determines, as abnormal ejection of a medium, whether curling of the front edge of a medium, curling of the rear edge of a medium, non-falling of the rear edge of a medium, flying out of a medium being ejected from the ejection tray 104, push-out of an ejected medium by a medium being ejected, or change in the order of media stacked on the ejection tray 104 has occurred. Consequently, the determination module 152 can properly detect abnormal ejection of a medium in the medium ejection apparatus 100 in which various types of abnormal ejection may occur.

The determination module 152 determines whether abnormal ejection of a medium has occurred based on the first ranging signal, the second ranging signal, and/or the third ranging signal. Consequently, the determination module 152 can properly detect various types of abnormal ejection.

The determination module 152 determines whether abnormal ejection of a medium has occurred based on the length of the medium. Consequently, the determination module 152 can more precisely determine whether abnormal ejection of a medium has occurred. The determination module 152 may determine whether abnormal ejection of a medium has occurred without using the length of the medium.

The determination module 152 determines whether abnormal ejection of a medium has occurred based on the thickness of a medium. Consequently, the determination module 152 can more precisely determine whether abnormal ejection of a medium has occurred. The determination module 152 may determine whether abnormal ejection of a medium has occurred without using the thickness of the medium. In that case, the first difference threshold value and the second difference threshold value are set assuming that the thickness of one medium has a fixed value.

When a hand of a user, etc., enters the emission range of the first range sensor 121, the second range sensor 122, or the third range sensor 123, the signal value of the ranging signal may change in spite of a medium not being ejected. Therefore, when the length of a continuous period in which each ranging signal decreases relative to each initial value is less than a predetermined period threshold value, the determination module 152 may assume that the ranging signal is changed by a hand of a user and exclude the signal from determination targets. Consequently, the determination module 152 can improve determination precision about whether abnormal ejection of a medium has occurred.

When a medium being ejected is bent, the signal value of each ranging signal may sharply change. Therefore, the determination module 152 may make each of the aforementioned determinations for the moving average of signal values of each ranging signal in a predetermined calculation period. Consequently, the determination module 152 can improve determination precision about whether abnormal ejection of a medium has occurred.

The determination module 152 only needs to execute at least one type of processing in steps S202 to S207, and other types of processing may be omitted.

Figure 21:
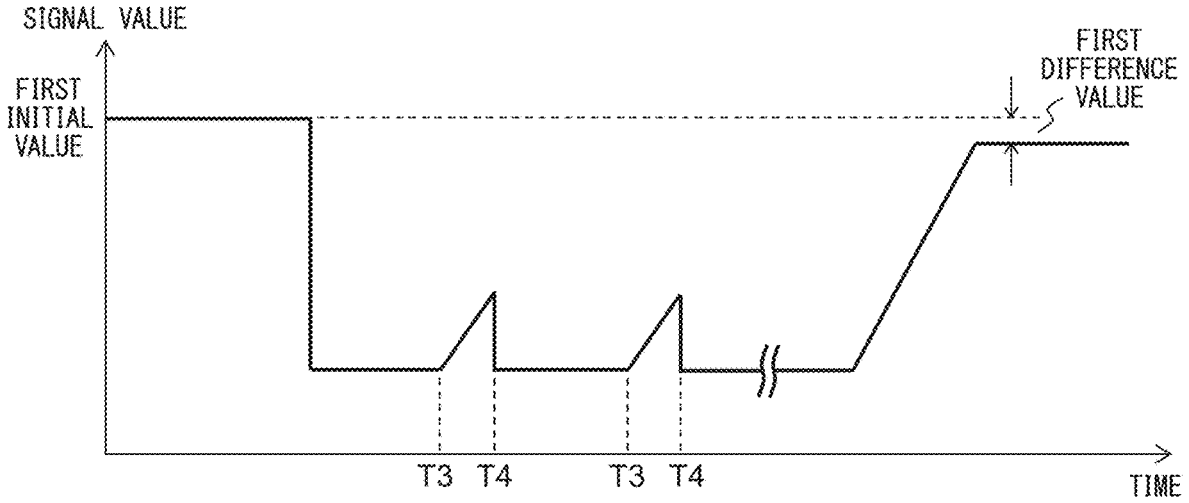
FIGS. 21(*a*) and 21(*b*) are graphs illustrating a characteristic of the ranging signal.
Figure 21:
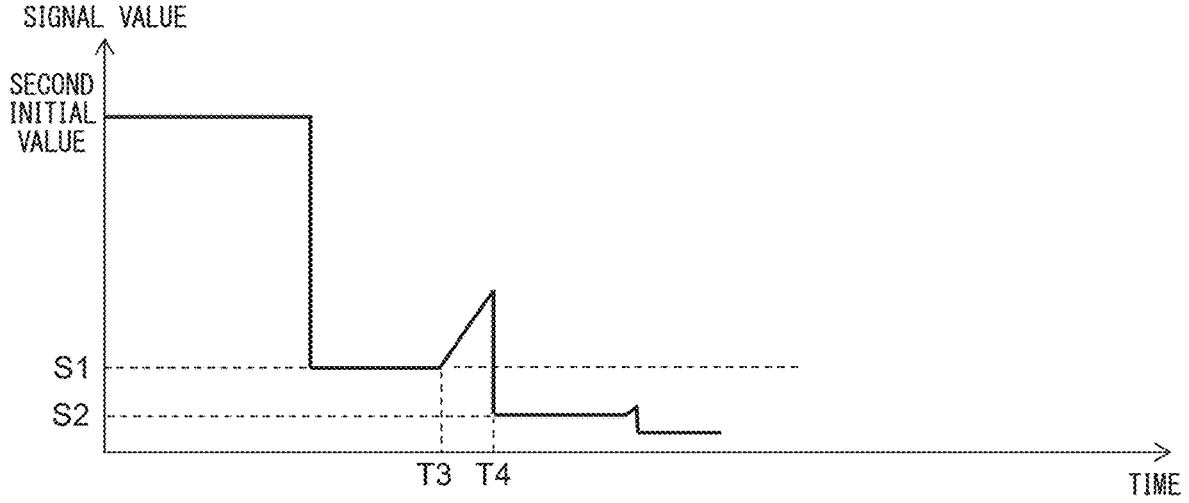

FIGS. 21(*a*) and 21(*b*) are graphs illustrating characteristics of the first ranging signal when a plurality of media are successively ejected in a short period. FIG. 21(*a*) illustrates a graph illustrating a characteristic of the first ranging signal when a plurality of media are successively ejected normally in a short period. FIG. 21(*b*) is a graph illustrating a characteristic of the first ranging signal when curling of the front edge or the rear edge of a medium occurs while a plurality of media are being successively ejected in a short period. In each of FIGS. 21(*a*) and 21(*b*), the vertical axis indicates the signal value, and the horizontal axis indicates time.

When a plurality of media are successively ejected, the front edge of a medium to be ejected next enters the emission range of the first range sensor 121 before the rear edge of a previously ejected medium falls to the placement surface 104*a*. Therefore, as illustrated in FIG. 21(*a*), when increasing from a decreased state [between a time T3 and a time T4 in FIG. 21(*a*)], the signal value of the first ranging signal decreases again [the time T4 in FIG. 21(*a*)] before returning to near the first initial value. When curling of the front edge or the rear edge of a medium occurs, a subsequently ejected medium is placed on the medium in which the curling has occurred. Therefore, as illustrated in FIG. 21(*b*), a signal value S2 of the first ranging signal acquired while the subsequently ejected medium is being ejected is less than a signal value S1 of the first ranging signal acquired while the previously ejected medium is being ejected.

Therefore, when the front edge of a medium passes the position of the second medium sensor 117 before an elapse of the aforementioned third time period after the rear edge of the previous medium passes the position of the second medium sensor 117, the determination module 152 changes the method for determining whether curling of the front edge or the rear edge of a medium has occurred. The determination module 152 determines whether the signal value of the first ranging signal increases by a first predetermined amount or greater after the rear edge of a medium passes the position of the second medium sensor 117 [between the time T3 and the time T4 in FIG. 21(*a*)]. The first predetermined amount is set to a value between an increased amount when a plurality of media are normally ejected and an increased amount when curling of a medium occurs through an experiment performed in advance. When the signal value of the first ranging signal does not increase by the first predetermined amount or greater, the determination module 152 determines that curling of a medium has occurred.

For each of successively ejected media, the determination module 152 calculates a minimum value of the signal value of the first ranging signal during ejection of the medium and determines whether the calculated minimum value has decreased from a minimum value for a medium ejected immediately before by a second predetermined amount or greater [comparison between the signal value S2 and the signal value S1 in FIG. 21(*b*)]. The second predetermined amount is set to a value between a decreased amount when a plurality of media are successively ejected normally and a decreased amount when curling of a medium occurs through an experiment performed in advance. When the calculated minimum value has decreased from the minimum value of the medium ejected immediately before by the second predetermined amount or greater, the determination module 152 determines that curling of a medium has occurred.

The determination module 152 determines whether a first difference value calculated for the first ranging signal acquired when ejection of successively ejected media is completed is greater than or equal to the first difference threshold value and determines that curling of the front edge of the medium M has occurred when the first difference value is greater than or equal to the first difference threshold value.

Consequently, the determination module 152 can precisely determine whether curling of a medium has occurred when a plurality of media are successively ejected in a short period.

Figure 22:
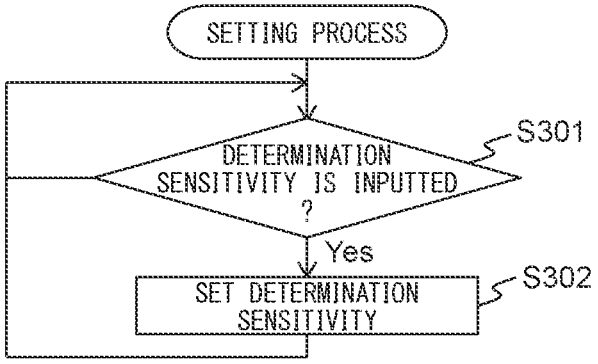
FIG. 22 is a flowchart illustrating an operation example of setting process.

FIG. 22 is a flowchart illustrating an operation example of setting process in the medium ejection apparatus 100.

The operation example of the setting process in an example of a medium ejection apparatus will be described below referring to the flowchart illustrated in FIG. 22. The operation flow described below is executed mainly by the processing circuit 150 in accordance with a program stored in advance in the storage device 140 in cooperation with the components in the medium ejection apparatus 100. The operation flow illustrated in FIG. 22 is executed at any timing.

First, the setting module 155 waits until a setting instruction about determination sensitivity to abnormal ejection of a medium is input by a user by using the operation device 105 or the information processing apparatus and an operation signal providing an instruction to perform setting is received from the operation device 105 or the interface device 132 (step S301). The determination sensitivity to abnormal ejection of a medium includes the first to seventh time periods, the first to third signal threshold values, the first and second difference threshold values, the first to fourth length threshold values, the first to third slope threshold values, the first and second predetermined amounts, the period threshold value, and the calculation period.

Next, the setting module 155 acquires the determination sensitivity to abnormal ejection of a medium specified by the user from the operation device 105 or the interface device 132, sets the determination sensitivity to the storage device 140 (step S302), and returns the process to step S301.

After this, the determination module 152 determines whether abnormal ejection of a medium has occurred based on the determination sensitivity set by the setting module 155. The type of medium conveyed and ejected by the medium ejection apparatus 100 varies for each user. By varying the determination sensitivity to abnormal ejection of a medium for each user, the medium ejection apparatus 100 can properly determine whether abnormal ejection of a medium has occurred according to the user's use. The user can increase the determination sensitivity in order to suppress damage to a medium when ejecting a medium susceptible to damage, such as thin paper, and can decrease the determination sensitivity in order to suppress erroneous detection of abnormal ejection of a medium when conveying a bent or wrinkled medium.

As described in detail above, the medium ejection apparatus 100 determines whether abnormal ejection of a medium has occurred by locating a plurality of range sensors in such a way as to measure the distances from above the outlet to the upstream side position and the downstream side position of an ejected medium. Consequently, the medium ejection apparatus 100 can properly detect various types of abnormal ejection, which enables precise determination of whether abnormal ejection of a medium has occurred.

The medium ejection apparatus 100 can properly detect various types of abnormal ejection particularly by monitoring both the front side (upstream side) and the back side (downstream side) of a medium ejected onto the ejection tray 104 viewed from the outlet. Further, by monitoring a state of a medium ejected onto the ejection tray 104 from above, the medium ejection apparatus 100 can reliably recognize the behavior of the medium regardless of the state of the medium (such as wrinkled, curled, or bent), which enables precise detection of abnormal ejection of a medium.

The medium ejection apparatus 100 can promptly stop ejection of a medium when abnormal ejection of the medium occurs and can consequently suppress occurrence of jamming of the medium, which suppresses occurrence of damage to the medium. In particular, since conveyance performance of the medium ejection apparatus 100 has been improved in recent years, it is difficult for a user to remove the jammed medium while continuing ejection of the medium when jamming of a medium occurs. By reliably stopping ejection of a medium when abnormal ejection of the medium occurs, the medium ejection apparatus 100 enables a user to reliably remove the jammed medium.

The medium ejection apparatus 100 can promptly reduce the ejection speed of a medium when abnormal ejection of the medium occurs and consequently can secure time for the next medium to be ejected and suppress the occurrence of collision between successively ejected media. Consequently, the medium ejection apparatus 100 can suppress the occurrence of jamming and damage of the medium.

The medium ejection apparatus 100 can promptly notify a user when abnormal ejection of a medium occurs and consequently can reduce time and effort for reordering media by the user, which can improve user convenience. Further, the user can stop or resume the medium reading process depending on the situation, and the medium ejection apparatus 100 can thus improve user convenience.

From the above, the medium ejection apparatus 100 can reduce the time required for restoration processing when abnormal ejection of a medium occurs and thus can suppress increase in the processing time of the medium reading processing.

Figure 23:
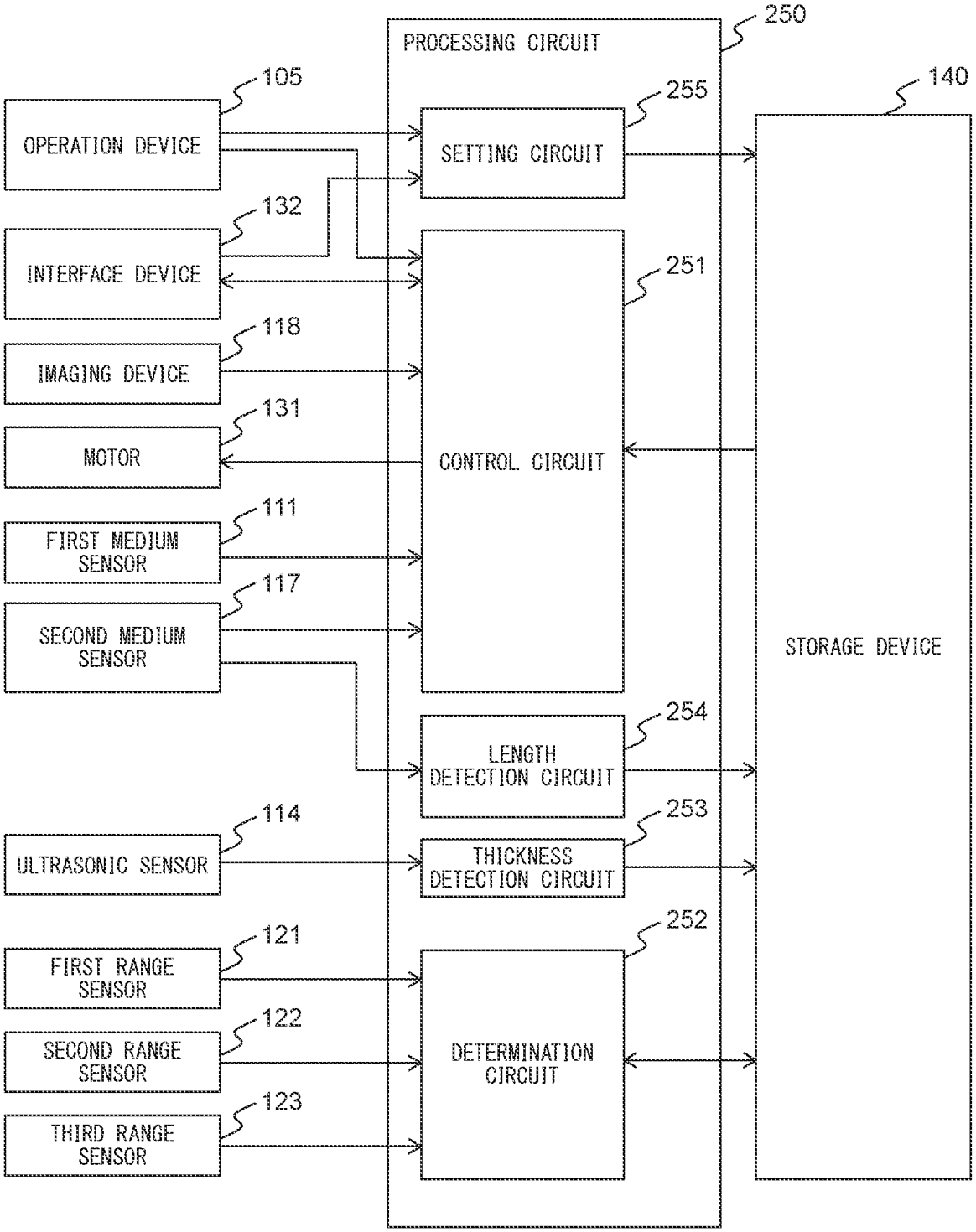
FIG. 23 is a diagram illustrating a schematic configuration of an example of another processing circuit.

FIG. 23 is a diagram illustrating a schematic configuration of an example of processing circuit in a medium ejection apparatus according to another embodiment. The processing circuit 250 is used in place of the processing circuit 150 in the medium ejection apparatus 100 and executes the medium reading process, the determination process, etc., in place of the processing circuit 150. The processing circuit 250 includes a control circuit 251, a determination circuit 252, a thickness detection circuit 253, a length detection circuit 254, a setting circuit 255, etc. Each component may be independently configured with an integrated circuit, a microprocessor, firmware, etc.

The control circuit 251 is an example of a control module and has a function similar to that of the control module 151. The control circuit 251 receives an operation signal from an operation device 105 or an interface device 132, a first medium signal from a first medium sensor 111, and a second medium signal from a second medium sensor 117. The control circuit 251 controls a motor 131 based on the received information, acquires an input image from an imaging device 118, and outputs the image to the interface device 132. Further, the control circuit 251 reads a determination result of abnormal ejection of a medium from a storage device 140 and executes the abnormality processing based on the read determination result.

The determination circuit 252 is an example of a determination module and has a function similar to that of the determination module 152. The determination circuit 252 acquires a first ranging signal from a first range sensor 121, a second ranging signal from a second range sensor 122, and a third ranging signal from a third range sensor 123 and reads detection results of the thickness and the length of a medium from the storage device 140. The determination circuit 252 determines whether abnormal ejection of a medium has occurred based on the acquired ranging signals and the read detection results, and stores the determination result into the storage device 140.

The thickness detection circuit 253 is an example of a thickness detection module and has a function similar to that of the thickness detection module 153. The thickness detection circuit 253 acquires an ultrasonic signal from an ultrasonic sensor 114, detects the thickness of a medium based on the ultrasonic signal, and stores the detection result into the storage device 140.

The length detection circuit 254 is an example of a length detection module and has a function similar to that of the length detection module 154. The length detection circuit 254 acquires a second medium signal from the second medium sensor 117, detects the length of a medium based on the second medium signal, and stores the detection result into the storage device 140.

The setting circuit 255 is an example of a setting module and has a function similar to that of the setting module 155. The setting circuit 255 receives an operation signal providing an instruction to set determination sensitivity to abnormal ejection of a medium from the operation device 105 or the interface device 132 and sets the specified determination sensitivity to the storage device 140.

As described in detail above, the medium ejection apparatus can precisely determine whether abnormal ejection of a medium has occurred in the case of using the processing circuit 250 as well.

With respect to the above-described embodiments, the following supplementary notes are further disclosed.

(Supplementary Note 1)

A medium ejection apparatus comprising:

an ejection roller to eject a medium;

a tray to stack the medium ejected by the ejection roller;

an optical sensor including a light emitter to emit light toward a downstream side of the tray in a medium ejecting direction and a light receiver to generate an optical signal based on received light; and a control module to execute abnormality processing based on the optical signal.

(Supplementary Note 2)

The medium ejection apparatus according to supplementary note 1, further comprising:

a second optical sensor located above the ejection roller and including a second light emitter to emit light toward the tray and a second light receiver to generate a second optical signal based on received light; and a determination module to determine whether abnormal ejection of the medium has occurred, based on the optical signal and the second optical signal, wherein the optical sensor is located above the ejection roller, and wherein the control module executes abnormality processing when it is determined that abnormal ejection of the medium has occurred.

(Supplementary Note 3)

A medium ejection apparatus comprising:

an ejection roller to eject a medium;

a facing roller located in such a way as to face the ejection roller;

a tray to stack the medium ejected by the ejection roller;

a first optical sensor located above the ejection roller and including a first light emitter to emit light in such a way that a distance from a downstream-side edge of a nip surface of the ejection roller and the facing roller to an intersection of the extension of the nip surface and a light emitting direction is less than a minimum size of a medium supported by the medium ejection apparatus, and a first light receiver to generate a first optical signal based on received light;

a second optical sensor located above the ejection roller and including a second light emitter to emit light toward a downstream side of a light emitting direction by the first light emitter in a medium ejecting direction and a second light receiver to generate a second optical signal based on received light; and a control module to execute abnormality processing based on the first optical signal and the second optical signal.

(Supplementary Note 4)

The medium ejection apparatus according to supplementary note 3, further comprising a determination module to determine whether abnormal ejection of the medium has occurred based on the first optical signal and the second optical signal, wherein the control module executes abnormality processing when it is determined that abnormal ejection of the medium has occurred.

(Supplementary Note 5)

The medium ejection apparatus according to supplementary note 2 or 4, wherein the determination module determines, as abnormal ejection of the medium, whether curling of a front edge of the medium, curling of a rear edge of the medium, non-falling of the rear edge of the medium, flying out of the medium being ejected from the tray, push-out of the medium which has been ejected by the medium being ejected, or change in an order of the media stacked on the tray has occurred.

(Supplementary Note 6)

The medium ejection apparatus according to any one of supplementary notes 1 to 5, further comprising a length detection module to detect a length of the medium, wherein the control module executes abnormality processing further based on the length of the medium.

(Supplementary Note 7)

The medium ejection apparatus according to any one of supplementary notes 1 to 6, further comprising a thickness detection module to detect a thickness of the medium, wherein the control module executes abnormality processing further based on the thickness of the medium.

(Supplementary Note 8)

The medium ejection apparatus according to supplementary note 2, 4 or 5, further comprising a setting module to set determination sensitivity to abnormal ejection of a medium specified by a user, wherein the determination module determines whether abnormal ejection of the medium has occurred based on the set determination sensitivity.

(Supplementary Note 9)

A control method of a medium ejection apparatus, the method comprising:

ejecting a medium by an ejection roller;

stacking the medium ejected by the ejection roller onto a tray;

executing abnormality processing based on an optical signal generated by an optical sensor including a light emitter to emit light toward a downstream side of the tray in a medium ejecting direction and a light receiver to generate the optical signal based on received light.

(Supplementary Note 10)

A control method of a medium ejection apparatus, the method comprising:

ejecting a medium by an ejection roller;

stacking the medium ejected by the ejection roller onto a tray;

executing abnormality processing based on, a first optical signal generated by a first optical sensor located above the ejection roller and including a first light emitter to emit light in such a way that a distance from a downstream-side edge of a nip surface of the ejection roller and a facing roller located in such a way as to face the ejection roller to an intersection of the extension of the nip surface and a light emitting direction is less than a minimum size of a medium supported by the medium ejection apparatus, and a first light receiver to generate the first optical signal based on received light, and a second optical signal generated by a second optical sensor located above the ejection roller and including a second light emitter to emit light toward a downstream side of a light emitting direction by the first light emitter in a medium ejecting direction and a second light receiver to generate the second optical signal based on received light.

(Supplementary Note 11)

A control program of a medium ejection apparatus including an ejection roller to eject a medium, a tray to stack the medium ejected by the ejection roller, an optical sensor including a light emitter to emit light toward a downstream side of the tray in a medium ejecting direction and a light receiver to generate an optical signal based on received light, the program causes the medium ejection apparatus to execute:

executing abnormality processing based on the optical signal.

(Supplementary Note 12)

A control program of a medium ejection apparatus including an ejection roller to eject a medium, a facing roller located in such a way as to face the ejection roller, a tray to stack the medium ejected by the ejection roller, a first optical sensor located above the ejection roller and including a first light emitter to emit light in such a way that a distance from a downstream-side edge of a nip surface of the ejection roller and the facing roller to an intersection of the extension of the nip surface and a light emitting direction is less than a minimum size of a medium supported by the medium ejection apparatus, and a first light receiver to generate a first optical signal based on received light, and a second optical sensor located above the ejection roller and including a second light emitter to emit light toward a downstream side of a light emitting direction by the first light emitter in a medium ejecting direction and a second light receiver to generate a second optical signal based on received light, the program causes the medium ejection apparatus to execute:

executing abnormality processing based on the first optical signal and the second optical signal.

REFERENCE SIGNS LIST

100 MEDIUM EJECTION APPARATUS, 104 Ejection tray, 119 First ejection roller, 120 Second ejection roller, 121 First range sensor, 121*a* First light emitter, 121*b* First light receiver, 122 Second range sensor, 122*a* Second light emitter, 122*b* Second light receiver, 123 Third range sensor, 123*a* Third light emitter, 123*b* Third light receiver, 151 Control module, 152 Determination module, 153 Thickness detection module, 154 Length detection module, 155 Setting module.

The invention claimed is:

1. A medium ejection apparatus comprising:

an ejection roller to eject a medium;

a tray to stack the medium ejected by the ejection roller;

an optical sensor including a light emitter, including a light emitting diode, to emit light toward a downstream side of the tray in a medium ejecting direction such that the light intersects with an extension surface of a placement surface of the tray and a light receiver, including a photodiode, to generate an optical signal based on received light; and a processor to execute abnormality processing based on the optical signal.

2. The medium ejection apparatus according to claim 1, wherein the processor determines whether abnormal ejection of the medium has occurred based on the optical signal, and wherein the processor executes abnormality processing when it is determined abnormal ejection of the medium has occurred.

3. The medium ejection apparatus according to claim 2, wherein the processor sets determination sensitivity to abnormal ejection of a medium specified by a user, and wherein the processor determines whether abnormal ejection of the medium has occurred based on the set determination sensitivity.

4. The medium ejection apparatus according to claim 1, further comprising a second optical sensor located above the ejection roller and including a second light emitter, including a light emitting diode, to emit light toward the tray and a second light receiver, including a photodiode, to generate a second optical signal based on received light, wherein the optical sensor is located above the ejection roller, and wherein the processor executes abnormality processing based on the optical signal and the second optical signal.

5. The medium ejection apparatus according to claim 4, wherein the processor determines whether abnormal ejection of the medium has occurred based on the optical signal and the second optical signal, and wherein the processor executes abnormality processing when it is determined that abnormal ejection of the medium has occurred.

6. The medium ejection apparatus according to claim 5, wherein the processor determines, as abnormal ejection of the medium, whether curling of a front edge of the medium, curling of a rear edge of the medium, non-falling of the rear edge of the medium, flying out of the medium being ejected from the tray, push-out of the medium which has been ejected by the medium being ejected, or change in an order of the media stacked on the tray has occurred.

7. The medium ejection apparatus according to claim 1, wherein the processor detects a length of the medium, and wherein the processor executes abnormality processing further based on the length of the medium.

8. The medium ejection apparatus according to claim 1, wherein the processor detects a thickness of the medium, and wherein the processor executes abnormality processing further based on the thickness of the medium.

9. A control method, the method comprising:

executing abnormality processing based on an optical signal generated by an optical sensor including a light emitter, including a light emitting diode, to emit light toward a downstream side of a tray to stack a medium ejected by an ejection roller in a medium ejecting direction such that the light intersects with an extension surface of a placement surface of the tray and a light receiver, including a photodiode, to generate the optical signal based on received light.

10. The method according to claim 9, wherein whether abnormal ejection of the medium has occurred is determined based on the optical signal, and wherein abnormality processing is executed when it is determined abnormal ejection of the medium has occurred.

11. The method according to claim 9, wherein the optical sensor is located above the ejection roller, and wherein abnormality processing is executed based on the optical signal and a second optical signal generated by a second optical sensor located above the ejection roller and including a second light emitter, including a light emitting diode, to emit light toward the tray and a second light receiver, including a photodiode, to generate a second optical signal based on received light.

12. The method according to claim 11, wherein whether abnormal ejection of the medium has occurred is determined based on the optical signal and the second optical signal, and wherein abnormality processing is executed when it is determined that abnormal ejection of the medium has occurred.

13. The method according to claim 12, wherein, as abnormal ejection of the medium, whether curling of a front edge of the medium, curling of a rear edge of the medium, non-falling of the rear edge of the medium, flying out of the medium being ejected from the tray, push-out of the medium which has been ejected by the medium being ejected, or change in an order of the media stacked on the tray has occurred is determined.

14. The method according to claim 7, further comprising detecting a length of the medium, wherein abnormality processing is executed further based on the length of the medium.

15. A computer-readable, non-transitory medium storing executable instructions, the executable instructions comprising:

executing abnormality processing based on an optical signal generated by an optical sensor including a light emitter, including a light emitting diode, to emit light toward a downstream side of a tray to stack a medium ejected by an ejection roller in a medium ejecting direction such that the light intersects with an extension surface of a placement surface of the tray and a light receiver, including a photodiode, to generate the optical signal based on received light.

16. The computer-readable, non-transitory medium according to claim 15, wherein the optical sensor is located above the ejection roller, and wherein abnormality processing is executed based on the optical signal and a second optical signal generated by a second optical sensor located above the ejection roller and including a second light emitter, including a light emitting diode, to emit light toward the tray and a second light receiver, including a photodiode, to generate a second optical signal based on received light.

17. The computer-readable, non-transitory medium according to claim 16, wherein whether abnormal ejection of the medium has occurred is determined based on the optical signal and the second optical signal, and wherein abnormality processing is executed when it is determined that abnormal ejection of the medium has occurred.

18. The computer-readable, non-transitory medium according to claim 17, wherein, as abnormal ejection of the medium, whether curling of a front edge of the medium, curling of a rear edge of the medium, non-falling of the rear edge of the medium, flying out of the medium being ejected from the tray, push-out of the medium which has been ejected by the medium being ejected, or change in an order of the media stacked on the tray has occurred is determined.

19. The computer-readable, non-transitory medium according to claim 15, the executable instructions further comprise detecting a length of the medium, wherein abnormality processing is executed further based on the length of the medium.

20. The computer-readable, non-transitory medium according to claim 15, wherein whether abnormal ejection of the medium has occurred is determined based on the optical signal, and wherein abnormality processing is executed when it is determined abnormal ejection of the medium has occurred.

* * * * *